US011396180B2

(12) United States Patent
Sato et al.

(10) Patent No.: US 11,396,180 B2
(45) Date of Patent: Jul. 26, 2022

(54) INKJET HEAD MANUFACTURING METHOD, INKJET RECORDING DEVICE MANUFACTURING METHOD, INKJET HEAD, AND INKJET RECORDING DEVICE

(71) Applicant: KONICA MINOLTA, INC., Tokyo (JP)

(72) Inventors: Yohei Sato, Hachioji (JP); Akihisa Shimomura, Atsugi (JP); Hikaru Hamano, Saitama (JP)

(73) Assignee: KONICA MINOLTA, INC., Tokyo (JP)

( * ) Notice: Subject to any disclaimer, the term of this patent is extended or adjusted under 35 U.S.C. 154(b) by 45 days.

(21) Appl. No.: 16/958,347

(22) PCT Filed: Dec. 26, 2017

(86) PCT No.: PCT/JP2017/046532
§ 371 (c)(1),
(2) Date: Jun. 26, 2020

(87) PCT Pub. No.: WO2019/130408
PCT Pub. Date: Jul. 4, 2019

(65) Prior Publication Data
US 2021/0060952 A1 Mar. 4, 2021

(51) Int. Cl.
*B41J 2/16* (2006.01)

(52) U.S. Cl.
CPC ..... *B41J 2/1623* (2013.01); *B41J 2/1607* (2013.01); *B41J 2202/13* (2013.01); *B41J 2202/22* (2013.01)

(58) Field of Classification Search
CPC .... B41J 2/1623; B41J 2/1607; B41J 2202/13; B41J 2202/22; B41J 2/14209;
(Continued)

(56) References Cited

U.S. PATENT DOCUMENTS

2013/0278673 A1* 10/2013 Takeuchi ..... B41J 2/1634 347/33
2014/0184705 A1 7/2014 Wakamatsu et al.

FOREIGN PATENT DOCUMENTS

CN 107433776 A 12/2017
EP 0970812 A1 1/2000
(Continued)

OTHER PUBLICATIONS

IP.com search (Year: 2022).*
(Continued)

*Primary Examiner* — Lisa Solomon
(74) *Attorney, Agent, or Firm* — Cantor Colburn LLP

(57) ABSTRACT

An inkjet head manufacturing method for an inkjet head that includes a head chip including: a nozzle ejecting ink; and a flow path substrate including an ink flow path which communicates with the nozzle and through which the ink flows, the method including: composite substrate manufacturing that is manufacturing a composite substrate including a plurality of regions which forms flow path substrates by being split; first protective film forming that is forming a first protective film on a surface of the composite substrate and an inner wall surface of the ink flow path; splitting that is splitting the composite substrate into the flow path substrates; and second protective film forming that is forming a second protective film on at least an exposed face in a split face of the flow path substrate generated in the splitting, the exposed face being exposed in a surface of the head chip.

9 Claims, 14 Drawing Sheets

(58) Field of Classification Search
CPC ..... B41J 2/1632; B41J 2/1646; B41J 2/1609; B41J 2/14233; B41J 2/161; B41J 2/1642
See application file for complete search history.

(56) References Cited

FOREIGN PATENT DOCUMENTS

| | | | |
|---|---|---|---|
| EP | 3248784 | A1 | 11/2017 |
| JP | 2011037055 | A | 2/2011 |
| JP | 2012218188 | A | 11/2012 |
| JP | 2013220613 | A | 10/2013 |
| JP | 2014198460 | A | 10/2014 |
| JP | 2015080918 | A | 4/2015 |

OTHER PUBLICATIONS

EPO Extended European Search Report for corresponding EP Application No. 17936326.2, dated Nov. 19, 2020.
International Preliminary Report on Patentability and Written Opinion of the International Searching Authority for corresponding PCT/JP2017/046532, dated Jun. 30, 2020.
International Search Report for International application No. PCT/JP2017/046532, dated Feb. 13, 2018.
CNIPA The First Office Action for corresponding CN Application No. 201780097915.0; dated Jan. 22, 2021.

* cited by examiner

INKJET HEAD MANUFACTURING METHOD, INKJET RECORDING DEVICE MANUFACTURING METHOD, INKJET HEAD, AND INKJET RECORDING DEVICE

CROSS REFERENCE TO RELATED APPLICATIONS

This is the U.S. national stage of application No. PCT/JP2017/046532, filed on Dec. 26, 2017. Priority under 35 U.S.C. § 119(a) and 35 U.S.C. § 365(b) is claimed, the disclosure of which is incorporated herein by reference.

TECHNICAL FIELD

The present invention relates to an inkjet head manufacturing method, an inkjet recording device manufacturing method, an inkjet head, and an inkjet recording device.

BACKGROUND ART

There has been conventionally an inkjet recording device which causes nozzles provided in inkjet heads to eject ink to form images or the like. As the inkjet head in the inkjet recording device, a head chip having nozzles and a flow path substrate provided with ink flow paths communicating with the nozzles is known.

As the flow path substrate used in the head chip, silicon and stainless steel are often used from the viewpoint of easiness of process. However, the substrate made of these materials have a problem that the substrate can be corroded by ink at the parts contacting the ink. When the ink flow path is corroded by ink or the surface of the flow path substrate is corroded by ink to allow the ink enter the flow path substrate, a desired amount of ink cannot be supplied to the nozzles, or ink leakage via unintended paths occur.

With respect to this, there has been conventionally a technique which suppresses the corrosion by ink by forming a protective film on the surface of flow path substrate and the inner wall surfaces of ink flow paths (for example, Patent Document 1). When a plurality of flow path substrates on which this protective film is formed is manufactured, there can be used a method of manufacturing a composite substrate having a plurality of regions which forms flow path substrates by being split, forming the protective film on the surface of the composite substrate and the inner wall surfaces of the ink flow paths, and thereafter splitting the composite substrate into each flow path substrate.

PRIOR ART DOCUMENT

Patent Document

Patent Document 1: Japanese Patent Application Laid Open Publication No. 2014-198460

DISCLOSURE OF THE INVENTION

Problems to be Solved by the Invention

However, in the flow path substrate manufactured by the above method, the protective film is not provided on the split face generated by the splitting of the composite substrate. Thus, there is a problem that the flow path substrate can be corroded by ink adhering to the split face when the split face is exposed in the surface of the head chip.

An object of this invention is to provide an inkjet head manufacturing method, an inkjet recording device manufacturing method, an inkjet head, and an inkjet recording device that can more surely suppress the corrosion of flow path substrate caused by ink.

Means for Solving the Problem

In order to achieve the above object, the invention of an inkjet head manufacturing method according to claim 1 is an inkjet head manufacturing method for an inkjet head that includes a head chip including: a nozzle that ejects ink; and a flow path substrate including an ink flow path which communicates with the nozzle and through which the ink flows, the method including: composite substrate manufacturing that is manufacturing a composite substrate including a plurality of regions which forms flow path substrates by being split, each of the flow path substrates being the flow path substrate; first protective film forming that is forming a first protective film on a surface of the composite substrate and an inner wall surface of the ink flow path; splitting that is splitting the composite substrate into the flow path substrates; and second protective film forming that is forming a second protective film on at least an exposed face in a split face of the flow path substrate generated in the splitting, the exposed face being exposed in a surface of the head chip.

The invention according to claim 2 is the inkjet head manufacturing method according to claim 1, further including nozzle substrate fixing that is directly or indirectly fixing a nozzle substrate, in which an opening of the nozzle is provided, to the flow path substrate after the second protective film forming.

The invention according to claim 3 is the inkjet head manufacturing method according to claim 1, further including nozzle substrate fixing that is directly or indirectly fixing a nozzle substrate, in which an opening of the nozzle is provided, to the flow path substrate before the second protective film forming, wherein the second protective film is formed on a surface of a layered substrate including the flow path substrate and the nozzle substrate in the second protective film forming.

The invention according to claim 4 is the inkjet head manufacturing method according to claim 2 or 3, further including exterior member bonding that is bonding an exterior member to the head chip including the nozzle substrate and the flow path substrate with an adhesive after the second protective film forming, the exterior member covering a part of the head chip while exposing a nozzle opening surface of the nozzle substrate in which the opening of the nozzle is provided, wherein a predetermined region excluding at least a part or whole of the exposed face of the flow path substrate in the surface of the head chip is bonded to the exterior member with the adhesive in the exterior member bonding.

The invention according to claim 5 is the inkjet head manufacturing method according to claim 4, in which the exterior member includes a recess, a through hole is provided in the exterior member, the through hole including an opening in an inner wall surface of the recess, and in the exterior member bonding, the exterior member is bonded to the head chip such that a portion including the nozzle opening surface and at least a part of the exposed face in the head chip protrudes outside the exterior member from the opening of the through hole.

The invention according to claim 6 is the inkjet head manufacturing method according to any one of claims 1 to 5, in which the first protective film is an inorganic oxide or an inorganic nitride that includes at least one of Ti, Al, Zr, Cr, Hf, Ni, Ta and Si, or polyparaxylylene.

The invention according to claim 7 is the inkjet head manufacturing method according to any one of claims 1 to 6, in which the second protective film is an inorganic oxide or an inorganic nitride that includes at least one of Ti, Al, Zr, Cr, Hf, Ni, Ta and Si, or polyparaxylylene.

The invention according to claim 8 is the inkjet head manufacturing method according to any one of claims 1 to 7, in which the flow path substrate is made of Si, metal or glass.

In order to achieve the above object, the invention of an inkjet recording device manufacturing method according to claim 9 is an inkjet recording device manufacturing method including the inkjet head manufacturing method according to any one of claims 1 to 8.

In order to achieve the above object, the invention of an inkjet head according to claim 10 is an inkjet head including a head chip including: a nozzle that ejects ink; and a flow path substrate including an ink flow path which communicates with the nozzle and through which the ink flows, in which the flow path substrate includes a lateral surface in which an opening of the ink flow path is not provided, a first protective film is provided on a surface of the flow path substrate excluding at least a part of the lateral surface and on an inner wall surface of the ink flow path, at least a part of a portion where the first protective film is not provided in the lateral surface is an exposed face that is exposed in a surface of the head chip, and a second protective film that is not integrally formed with the first protective film is provided on the exposed face.

The invention according to claim 11 is the inkjet head according to claim 10, in which the portion where the first protective film is not provided in the lateral surface is a split face that is generated in splitting a composite substrate into flow path substrates each of which is the flow path substrate, the composite substrate including a plurality of regions which forms the flow path substrates by being split.

The invention according to claim 12 is the inkjet head according to claim 10 or 11, in which the head chip includes a nozzle substrate in which an opening of the nozzle is provided, and the second protective film is provided on a surface of a layered substrate including the flow path substrate and the nozzle substrate.

The invention according to claim 13 is the inkjet head according to any one of claims 10 to 12, further including an exterior member that covers a part of the head chip while exposing a nozzle opening surface of a nozzle substrate in which an opening of the nozzle is provided, in which the head chip includes the nozzle substrate in which the opening of the nozzle is provided, and a predetermined region excluding at least a part or whole of the exposed face of the flow path substrate in the surface of the head chip is bonded to the exterior member with an adhesive.

The invention according to claim 14 is the inkjet head according to claim 13, in which the exterior member includes a recess, a through hole is provided in the exterior member, the through hole including an opening in an inner wall surface of the recess, and a portion including the nozzle opening surface and at least a part of the exposed face in the head chip protrudes outside the exterior member from the opening of the through hole.

The invention according to claim 15 is the inkjet head according to any one of claims 10 to 14, in which the first protective film is an inorganic oxide or an inorganic nitride that includes at least one of Ti, Al, Zr, Cr, Hf, Ni, Ta and Si, or polyparaxylylene.

The invention according to claim 16 is the inkjet head according to any one of claims 10 to 15, in which the second protective film is an inorganic oxide or an inorganic nitride that includes at least one of Ti, Al, Zr, Cr, Hf, Ni, Ta and Si, or polyparaxylylene.

The invention according to claim 17 is the inkjet head according to any one of claims 10 to 16, in which the flow path substrate is made of Si, metal or glass.

In order to achieve the above object, the invention of an inkjet recording device according to claim 18 is an inkjet recording device including the inkjet head according to any one of claims 10 to 17.

Effects of the Invention

According to the present invention, there is an effect that it is possible to more surely suppress the corrosion of flow path substrate caused by ink.

EMBODIMENTS FOR CARRYING OUT THE INVENTION

Hereinafter, embodiments according to an inkjet head manufacturing method, an inkjet recording device manufacturing method, an inkjet head, and an inkjet recording device of the present invention will be described with reference to the drawings.

First Embodiment

Figure 1:
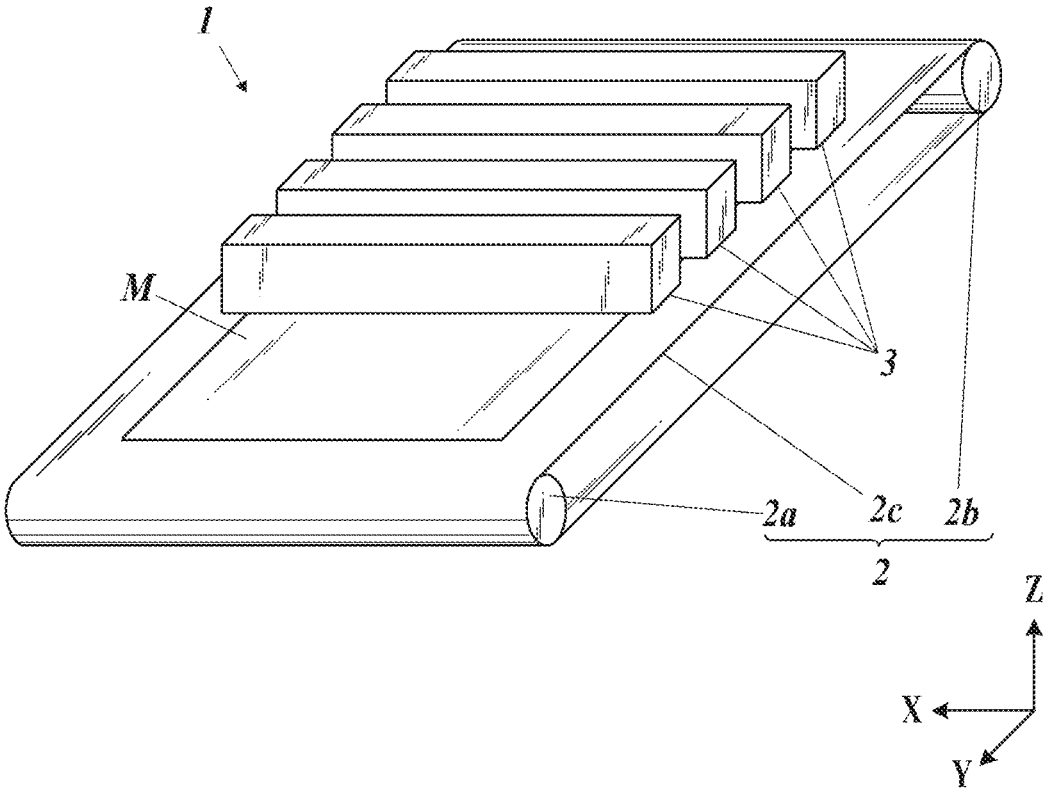
FIG. 1 is a view showing an outline configuration of an inkjet recording device.

FIG. 1 is a view showing a perspective configuration of an inkjet recording device 1 which is a first embodiment of the present invention.

The inkjet recording device 1 includes a conveyance unit 2, a head unit 3, and the like.

The conveyance unit 2 includes a ring-shaped conveyance belt 2*c* the inside of which is supported by two conveyance rollers 2*a* and 2*b* which rotate around a rotation shaft extending in the X direction of FIG. 1. The conveyance unit 2 conveys a recording medium M in a movement direction of the conveyance belt 2*c* (conveyance direction; Y direction in FIG. 1) by the conveyance roller 2*a* rotating according to the operation of a conveyance motor not shown in the drawings to cause the conveyance belt 2*c* to perform a rotary movement, in a state in which the recording medium M is placed on the conveyance surface of the conveyance belt 2*c*.

The recording medium M can be a sheet of paper which is cut to have a fixed size. The recording medium M is supplied onto the conveyance belt 2*c* by a sheet feeding device not shown in the drawings, and ejected to a predetermined sheet ejection unit from the conveyance belt 2*c* after the ink is ejected from the head unit 3 to record an image. As the recording medium M, roll paper may be used. As the recording medium M, in addition to paper such as plain paper and coated paper, various mediums such as fabric or sheet resin that allows ink attached to the surface thereof to be fixed can be used.

The head unit 3 ejects ink at an appropriate timing based on image data to the recording medium M conveyed by the conveyance unit 2, to record an image. In the inkjet recording device 1 in the present embodiment, four head units 3 respectively corresponding to four colors of yellow (Y), magenta (M), cyan (C), and black (K) are arranged at predetermined intervals in the order of Y, M, C, and K colors from the upstream side in the conveyance direction of recording medium M. The number of head units 3 may be three or less, or five or more.

Figure 2:
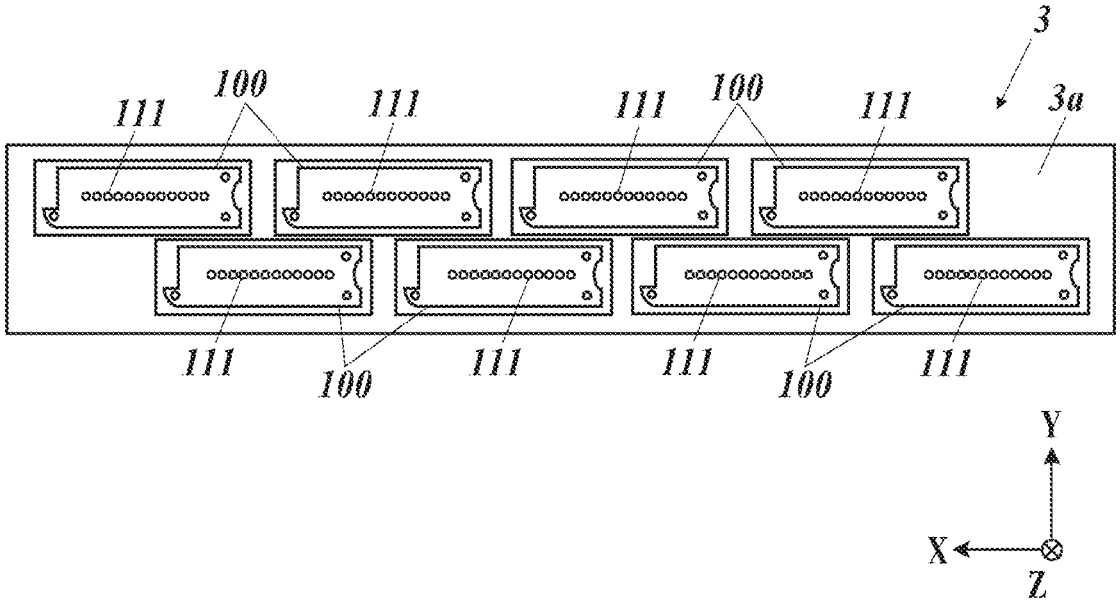
FIG. 2 is a schematic view showing the configuration of a head unit.

FIG. 2 is a schematic view showing the configuration of head unit 3, and is a plan view seen from the side opposing the conveyance surface of the conveyance belt 2*c* of the head unit 3. The head unit 3 has a plate base portion 3*a* and a plurality of (eight in the embodiment) inkjet heads 100 which are fixed to the base portion 3*a* in a state in which the inkjet heads 100 are fitted to through holes provided in the base portion 3*a*. The inkjet heads 100 are fixed to the base portion 3*a* in a state in which nozzle opening surface in which openings of nozzles 111 are provided are exposed toward −Z direction from the through holes of the base portion 3*a*.

In each of the inkjet heads 100, a plurality of nozzles 111 are arranged at equal intervals in a direction (width direction orthogonal to the conveyance direction in the present embodiment, that is, X direction) crossing the conveyance direction of recording medium M. In detail, each of the inkjet heads 100 has a row of nozzles 111 (nozzle row) which are one-dimensionally arranged at equal intervals in the X direction.

The inkjet head 100 may have a plurality of nozzle rows. In this case, the plurality of nozzle rows are disposed at positions in the X direction shifted from each other so that the positions in the X direction of the nozzles 111 do not match.

The eight inkjet heads 100 in the head unit 3 are arranged in a staggered manner so that the arrangement range in the X direction of the nozzles 111 is continuous. The arrangement range in the X direction of the nozzles 111 included in the head unit 3 cover the width in the X direction of the region where the image can be recorded in the recording medium M conveyed by the conveyance belt 2*c*. The head unit 3 is used with its position fixed at the time of image recording, and the head unit 3 records an image with a single pass method by ejecting ink from the nozzles 111 to respective positions at predetermined intervals in the conveyance direction (intervals in conveyance direction) in accordance with the conveyance of recording medium M.

Figure 3:
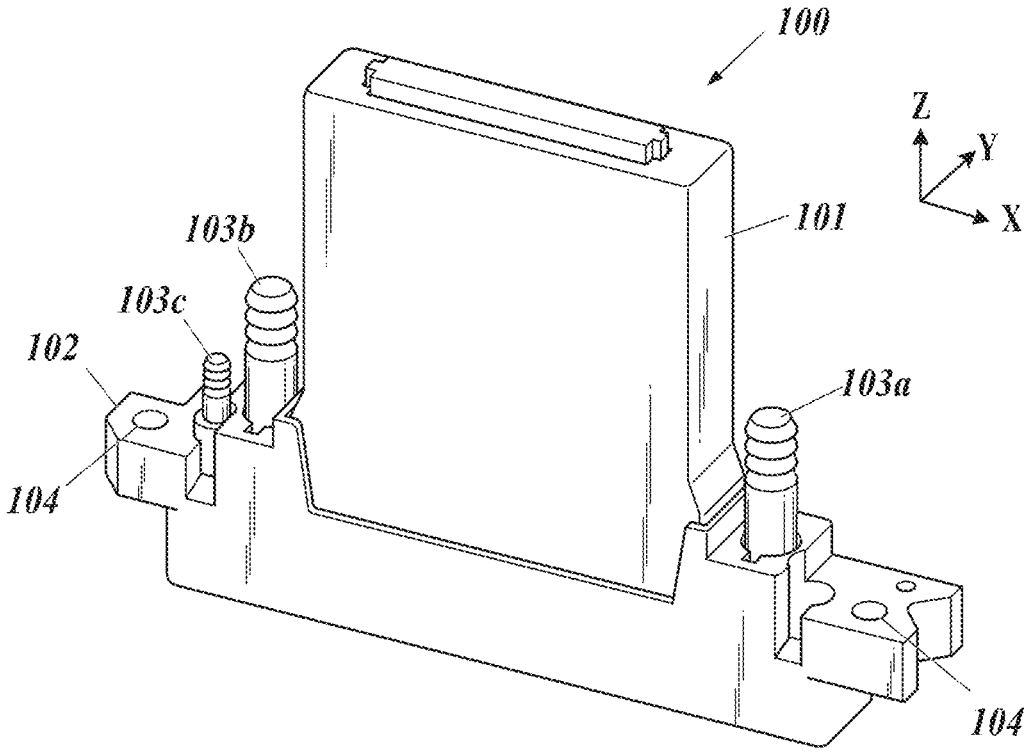
FIG. 3 is a perspective view of an inkjet head.

FIG. 3 is a perspective view of the inkjet head 100.

The inkjet head 100 includes a housing 101 and an exterior member 102 which is fitted to the housing 101 at the lower end of the housing 101. The main components are contained inside the housing 101 and the exterior member 102. Among them, in the exterior member 102, an inlet 103*a* to which ink is supplied from outside, and outlets 103*b* and 103*c* from which ink is discharged to outside are provided. A plurality of attachment holes 104 for attaching the inkjet head 100 to the base portion 3*a* in the head unit 3 are provided in the exterior member 102.

Figure 4:
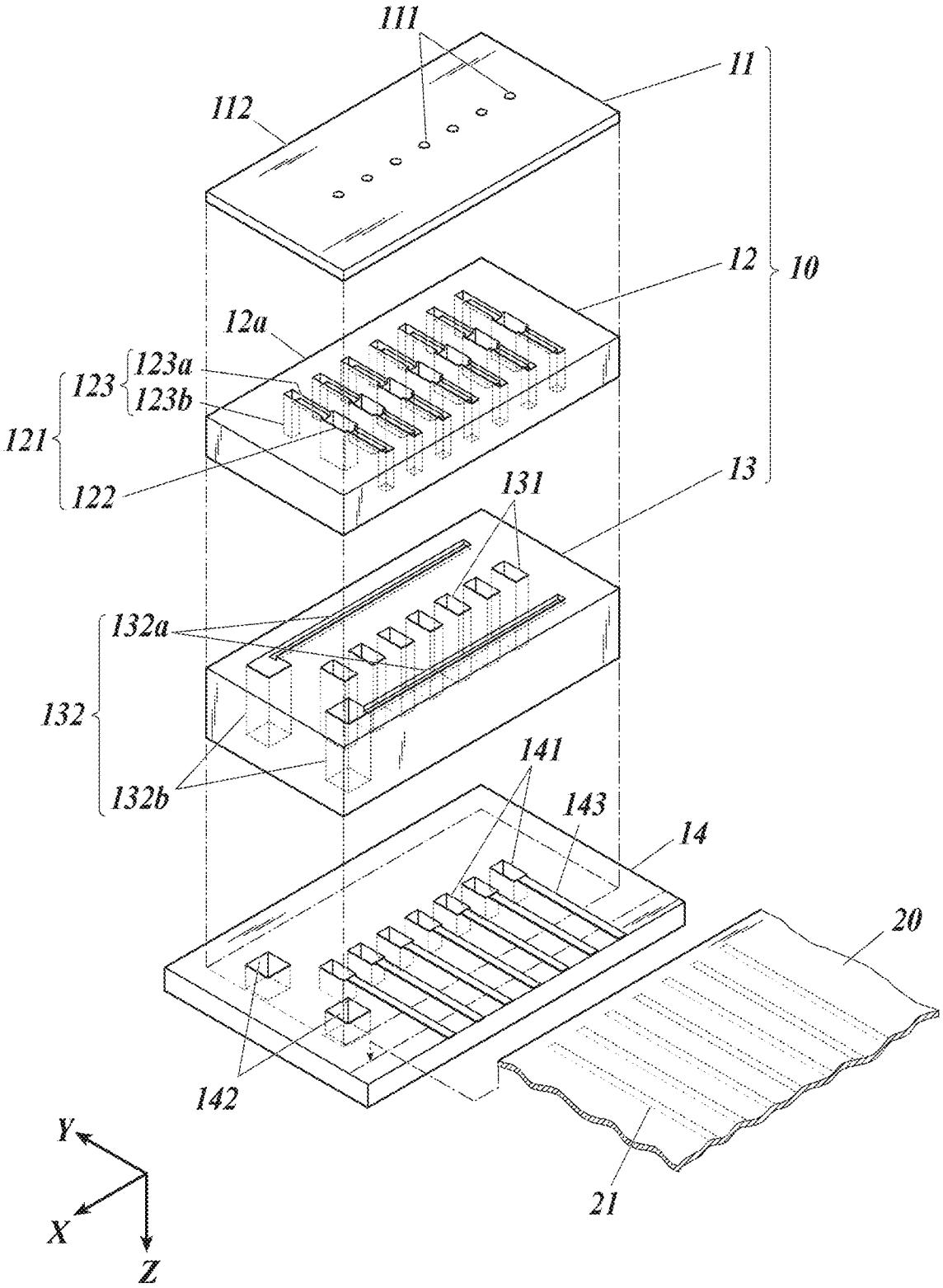
FIG. 4 is an exploded perspective view of main parts of the inkjet head.

FIG. 4 is an exploded perspective view of the main parts of the inkjet head 100.

FIG. 4 shows main components contained inside the exterior member 102 among the components of the inkjet head 100. To be specific, FIG. 4 shows a head chip 10 having a nozzle substrate 11, a flow path spacer substrate 12 (flow path substrate) and a pressure chamber substrate 13, a wiring substrate 14 which is fixed to the head chip 10, and an FPC 20 (Flexible Printed Circuit) which is electrically connected to the wiring substrate 14. FIG. 4 shows each component such that the nozzle opening surface 112 of the inkjet head 100 is located on the upper side, that is, such that the image is shown upside down with respect to FIG. 2. Hereinafter, the surface on −Z direction side of each substrate will also be referred to as an upper surface, and the surface on +Z direction side of each substrate will also be referred to as a lower surface.

The head chip 10 has a structure accumulating layers of the nozzle substrate 11 including nozzles 111, flow path spacer substrate 12 including ink flow paths 121 which communicate with the nozzles 111, and pressure chamber substrate 13 including pressure chambers 131 which communicate with the nozzles 111 via the ink flow paths 121 and the like. All of the nozzle substrate 11, flow path spacer substrate 12, pressure chamber substrate 13 and wiring substrate 14 are plate members in nearly quadrangular prism shapes which are long in the X direction.

The material of pressure chamber substrate 13 is a piezoelectric body (member which is deformed in accordance with voltage application) of ceramics. The examples of such a piezoelectric body include PZT (lead zirconate titanate), lithium niobate, barium titanate, lead titanate, lead metaniobate, and the like. PZT is used for the pressure chamber substrate 13 in the present embodiment.

The pressure chambers 131 in the pressure chamber substrate 13 are through holes which are respectively provided at the positions matching the positions of nozzles 111 when seen from the Z direction in the pressure chamber substrate 13. The cross section of each of the pressure chambers 131 along the X-Y plane is a rectangle which is long in the Y direction. In the pressure chamber substrate 13 in the present embodiment, the plurality of pressure chambers 131 are arranged to form a row along the X direction.

The ink is supplied via an ink supply port provided on the wiring substrate 14 to each of the pressure chambers 131. Each of the pressure chambers 131 is communicating with the nozzle 111 via the ink flow path 121 of the flow path spacer substrate 12.

Figure 5:
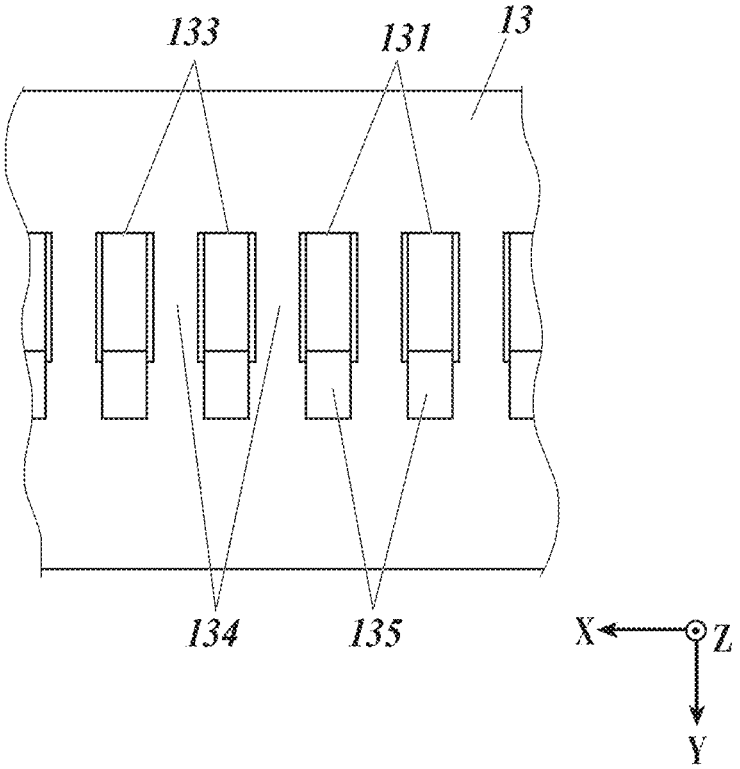
FIG. 5 is an enlarged plan view of a pressure chamber substrate.

FIG. 5 is an enlarged plan view of the pressure chamber substrate 13. FIG. 5 is a plan view of the portion around the pressure chambers 131 in the pressure chamber substrate 13 seen from the lower side (from +Z direction side) of FIG. 4.

As shown in FIG. 5, each pressure chambers 131 which are adjacent in the X direction are partitioned by a dividing wall 134 of the piezoelectric body. Metal drive electrodes 133 are provided on inner wall surfaces of the dividing wall 134 of each pressure chambers 131. Metal connection electrodes 135 which are electrically connected to the drive electrodes 133 are provided in regions around the +Y direction side of the openings of pressure chambers 131 in the surface of the pressure chamber substrate 13. The connection electrodes 135 are electrically connected to an external drive circuit via wirings 143 of the wiring substrate 14 shown in FIG. 4, and wirings 21 of the FPC 20.

In the pressure chamber substrate 13, the pressure of ink inside each of the pressure chambers 131 changes by the dividing wall 134 repeating the shear mode type displacement according to the drive signal applied to the drive electrode 133 via the connection electrode 135. In response to this change in the pressure, the ink in the pressure chamber 131 is ejected from the nozzle 111 via the ink flow path 121. That is, the head chip 10 in the present embodiment is a head chip which performs shear mode type ink ejection.

Instead of the pressure chamber 131, an air chamber not supplying ink may be provided at an every other position for the pressure chamber 131 in the X direction in FIG. 5. By having such a configuration, it is possible to prevent the deformation of dividing wall 134 adjacent to one pressure chamber 131 from influencing the other pressure chamber 131.

As shown in FIG. 4, the pressure chamber substrate 13 includes common ink discharge flow paths 132 to which ink partially inflows back, the ink not having been ejected from the nozzles 111 in the ink supplied to the ink flow paths 121 of the flow path spacer substrate 12 from the pressure chambers 131. The two common ink discharge flow paths 132 are provided at the respective positions having the plurality of pressure chambers 131 therebetween in the Y direction. Each of the common ink discharge flow paths 132 includes, near the end in the Y direction, a groove-like horizontal common discharge flow path 132*a* extending in the X direction along the surface on the flow path spacer substrate 12 side of the pressure chamber substrate 13 and a vertical common discharge flow path 132*b* penetrating in the Z direction the pressure chamber substrate 13 and connected to the horizontal common discharge flow path 132*a* at the end on the +X direction side of the horizontal common discharge flow path 132*a*. The ink which inflows back to the horizontal common discharge flow path 132*a* from the ink flow paths 121 of the flow path spacer substrate 12 is discharged outside the inkjet head 100 from the outlet 103*b* (or outlet 103*c*) through the vertical common discharge flow path 132*b* and the discharge hole 142 provided in the wiring substrate 14.

The flow path spacer substrate 12 is a plate member in a rectangular parallelepiped shape having a size which is nearly equal to the pressure chamber substrate 13 in a plan view. The flow path spacer substrate 12 is bonded (fixed) via an adhesive to the upper surface of the pressure chamber substrate 13. The flow path spacer substrate 12 in the present embodiment is formed of a silicon substrate. Though not particularly limited, the thickness of the flow path spacer substrate 12 is approximately several hundred μm.

Each of the ink flow paths 121 provided in the flow path spacer substrate 12 includes: a through flow path 122 penetrating the flow path spacer substrate 12 at a position matching the position where the pressure chamber 131 is formed when seen from the Z direction; and an individual ink discharge flow path 123 diverging from the through flow path 122.

The shape of the cross section parallel to the X-Y plane of the through flow path 122 is a rectangle which is nearly same as the shape of the cross section of the pressure chamber 131. The opening on the pressure chamber substrate 13 side of the through flow path 122 is connected to the pressure chamber 131, and the opening on the nozzle substrate 11 side is connected to the nozzle 111.

The individual ink discharge flow path 123 includes: a pair of horizontal individual discharge flow paths 123*a* in groove shapes which are respectively extending in the +Y direction and the −Y direction along the surface of the flow path spacer substrate 12 from the opening on the nozzle substrate 11 side of the through flow path 122; and vertical individual discharge flow paths 123*b* provided to penetrate the flow path spacer substrate 12 from the respective ends of the horizontal individual discharge flow paths 123*a*. The openings on the pressure chamber substrate 13 side of the vertical individual discharge flow paths 123*b* are respectively connected to the horizontal common discharge flow paths 132*a* of the common ink discharge flow path 132. Accordingly, the individual ink discharge flow path 123 leads the ink, which flows in the horizontal individual discharge flow path 123*a* from the through flow path 122, to the common ink discharge flow path 132 via the vertical individual discharge flow path 123*b*.

In such a way, the individual ink discharge flow paths 123 provided in the flow path spacer substrate 12 and the common ink discharge flow paths 132 provided in the pressure chamber substrate 13 form the ink discharge flow paths for discharging the ink which was not ejected from the nozzles 111 in the ink inside the pressure chambers 131.

The four faces which connect the upper surface and the lower surface of the flow path spacer substrate 12 to each other and in which the opening of the ink flow path 121 is not provided are hereinafter referred to as lateral surfaces.

The flow path spacer substrate 12 is manufactured by splitting a composite flow path spacer substrate 12M (composite substrate) (FIG. 11A) into the flow path spacer substrates 12 (splitting into individual pieces), the composite flow path spacer substrate 12M including a plurality of regions which forms the flow path spacer substrates 12 by being split. Thus, at least a part of the four lateral surfaces of the flow path spacer substrate 12 is a split face (cross section) which was generated when the composite flow path spacer substrate 12M was split into flow path spacer substrates 12. The split face of the flow path spacer substrate 12 is exposed in the surface of the head chip 10. Hereinafter, the split face exposed in the surface of the head chip 10 is referred to as an exposed face 12*a*.

The nozzle substrate 11 is a silicon substrate in which the nozzles 111 that are holes running through the thickness direction (Z direction) are provided in a line. The nozzles 111 are provided at respective positions matching the positions of through flow paths 122 in the ink flow paths 121 of the flow path spacer substrate 12 when seen from the Z direction. The planar shape of the nozzle substrate 11 is nearly same as the shape of the flow path spacer substrate 12 and the pressure chamber substrate 13. The upper surface of the nozzle substrate 11 forms the nozzle opening surface 112 of the inkjet head 100. The thickness of the nozzle substrate 11 is approximately several tens of μm to several hundreds of μm, for example.

The inner wall surface of each of the nozzles 111 may have a taper shape such that the cross sectional area vertical to the Z direction which is closer to the opening on the ink ejection side is smaller. The nozzle substrate 11 may be configured by including resin such as polyimide, metal or the like. It is desirable that the opening surface 112 of the nozzle substrate 11 is provided with a water-repellent film including a liquid repellent material such as fluorine resin particles. By providing the water-repellent film, it is possible to suppress the adhering of ink and foreign substances to the nozzle opening surface 112, and suppress the occurrence of ink ejection defects caused by the adhering of ink, foreign substances and the like.

The nozzle substrate 11 is manufactured by splitting a composite nozzle substrate 11M (composite substrate) (FIG. 10A) into nozzle substrates 11, the composite nozzle substrate 11M having a plurality of regions which forms nozzle substrates 11 by being split, similarly to the flow path spacer substrate 12. Thus, at least a part of the four lateral surfaces connecting the upper surface and the lower surface of the nozzle substrate 11 is a split face which was generated when the composite nozzle substrate 11M was split into the nozzle substrates 11. Hereinafter, the split face of the nozzle substrate 11 exposed in the surface of the head chip 10 is referred to as an exposed face 11*a*.

It is preferable that the wiring substrate 14 is a substrate in a flat plate shape having an area larger than an area of the pressure chamber substrate 13 from the view point of securing the bonding region with the pressure chamber substrate 13, and the wiring substrate 14 is bonded to the lower surface of the pressure chamber substrate 13 via an adhesive. As the wiring substrate 14, a substrate of glass, ceramics, silicon, plastic or the like can be used, for example.

The wiring substrate 14 includes a plurality of ink supply ports 141 at positions matching the positions of the plurality of pressure chambers 131 of the pressure chamber substrate 13 when seen from the Z direction, and a pair of discharge holes 142 are provided at positions matching the positions of the pair of vertical common discharge flow paths 132*b*. A plurality of wirings 143 extending toward the end of the wiring substrate 14 from the respective ends of the plurality of ink supply ports 141 are provided on the bonding surface between the wiring substrate 14 and the pressure chamber substrate 13.

An ink manifold (common ink chamber) not shown in the drawings is connected to the lower surface of the wiring substrate 14, and ink is supplied to the ink supply ports 141 from the ink manifold.

The wiring substrate 14 is manufactured by splitting a composite wiring substrate (composite substrate) into wiring substrates 14, the composite wiring substrate having a plurality of regions which forms the wiring substrates 14 by being split, similarly to the flow spacer substrate 12. Thus, at least a part of the four lateral surfaces (two faces on the +Y direction side and −Y direction side in the embodiment) connecting the upper surface and the lower surface of the wiring substrate 14 is a split face which was generated when the composite wiring substrate was split into the wiring substrates 14. Hereinafter, the split face of the wiring substrate 14 exposed in the surface of the head chip 10 is referred to as the exposed face 14*a*.

The pressure chamber substrate 13 and the wiring substrate 14 are bonded via an electrical conductive adhesive containing electrical conductive particles. Thus, the connection electrodes 135 on the surface of the pressure chamber substrate 13 and the wirings 143 on the wiring substrate 14 are electrically connected via the electrical conductive particles.

The FPC 20 is connected to the end of the wiring substrate 14 provided with the wirings 143 via the ACF (Anisotropic Conductive Film), for example. By this connection, the plurality of wirings 143 of the wiring substrate 14 are electrically connected to the plurality of wirings 21 on the FPC 20 such that the wirings 143 correspond to the respective wirings 21.

Figure 6:
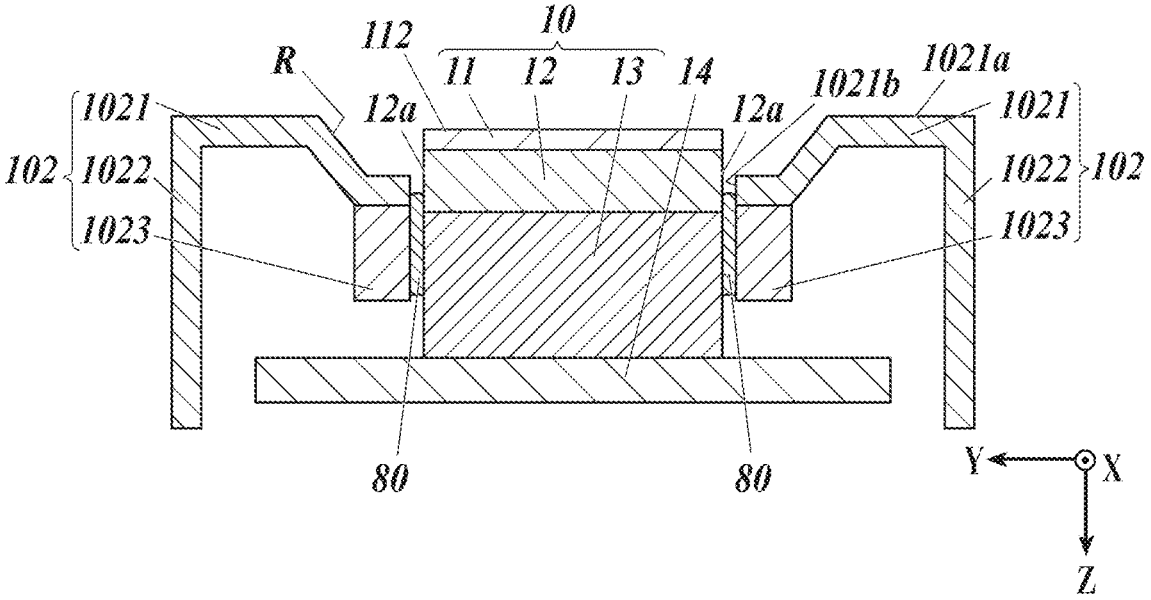
FIG. 6 is a schematic sectional view of a portion including a head chip in the inkjet head.

FIG. 6 is a schematic sectional view of a portion including the head ship 10 in the inkjet head 100. FIG. 6 shows a cross section vertical to the X direction of the inkjet head 100. FIG. 6 draws exaggerating the thicknesses of the nozzle substrate 11 and the flow path spacer substrate 12 for convenience of explanation.

As shown in FIG. 6, the exterior member 102 is provided to cover a part of the head chip 10 with the nozzle opening surface 112 of the nozzle substrate 11 in the head chip 10 exposed. The exterior member 102 is bonded to the head chip 10 via an adhesive 80.

In detail, the exterior member 102 includes a top board 1021 (recess formed portion), a lateral wall 1022 and a sealing plate 1023. Though the material of each component of the exterior member 102 is not particularly limited, various resins such as PPS resin, metal, alloy or the like which is excellent in the mechanical strength and resistance to ink can be used.

The top board 1021 is a rectangular plate member having a shape in which the upper surface (hereinafter, referred to as recess formed surface 1021*a*) has a recessed shape at the central portion to have a recess R. An exposing through hole 1021*b* (through hole) having an opening at the deepest part of the recess R is provided in the top board 1021. The head chip 10 is provided in a state in which the portion, which includes the nozzle opening surface 112 and at least a part of the split faces (exposed faces 12*a*) generated in splitting into the individual pieces of flow path spacer substrates 12, protrude outside the exterior member 102 in the range within the recess R from the opening of the exposing through hole 1021*b* of the top board 1021. By such a configuration, it is possible to facilitate the contact of wiping member with the nozzle opening surface 112 when the recess formed surface 1021*a* of the top board 1021 and the nozzle opening surface 112 are wiped with the wiping member such as a wiping cloth.

Moreover, since the protruding range of the head chip 10 is within the recess R, the nozzle opening surface 112 of the head chip 10 is provided at the position deeper toward the +Z direction side than the face of the portion excluding the recess R in the recess formed surface 1021*a* in the top board 1021. Thus, it is possible to prevent the nozzle opening surface 112 from easily contacting the recording medium M or foreign substances on the conveyance surface of the conveyance belt 2*c*.

The lateral wall 1022 is a plate member which is connected to the outer circumference of the top board 1021 and covers the lateral side of the head chip 10. A member separate from the top board 1021 may be used for the lateral wall 1022, or the lateral wall 1022 may be integrally provided with the top board 1021.

The sealing plate 1023 is a plate member which is connected to the exposing through hole 1021*b* of the top board 1021, and extending along the lateral surfaces of the flow path spacer substrate 12 and the pressure chamber substrate 13 in the head chip 10. A member separate from the top board 1021 may be used for the sealing plate 1023, or the sealing plate 1023 may be integrally provided with the top board 1021.

The inner circumferential surface of the sealing plate 1023 (surface facing the flow path spacer substrate 12 and the pressure chamber substrate 13) and the lateral surfaces of the flow path spacer substrate 12 and the pressure chamber substrate 13 are bonded to each other via the adhesive 80. Though not particularly limited, a known epoxy type adhesive, for example, can be used as the material of the adhesive 80. By such a configuration, the gap between the exterior member 102 and the head chip 10 is sealed. That is, the adhesive 80 also achieves the role as a sealing member which prevents the entrance of ink from outside.

The adhesive 80 coming around the nozzle opening surface 112 influences the ink ejection from the nozzles 111 and leads to the occurrence of trouble that the recording medium M facing the nozzle opening surface 112 contact the adhesive 80. Thus, it is desirable that the adhesive 80 is provided only on the lateral surfaces of the head chip 10, and thus, the adhesive 80 is provided in the range excluding a predetermined neighboring range from the upper ends of the lateral surfaces of the head chip 10. In detail, the adhesive 80 is provided in each predetermined region not covering the range from the lateral surface of the nozzle substrate 11 to a part of the exposed face 12*a* of the flow path spacer substrate 12 in each of the lateral surfaces of the head ship 10. Accordingly, a part of each of the exposed faces 12*a* of the flow path spacer substrate 12 is exposed from the exterior member 102.

Figure 7:
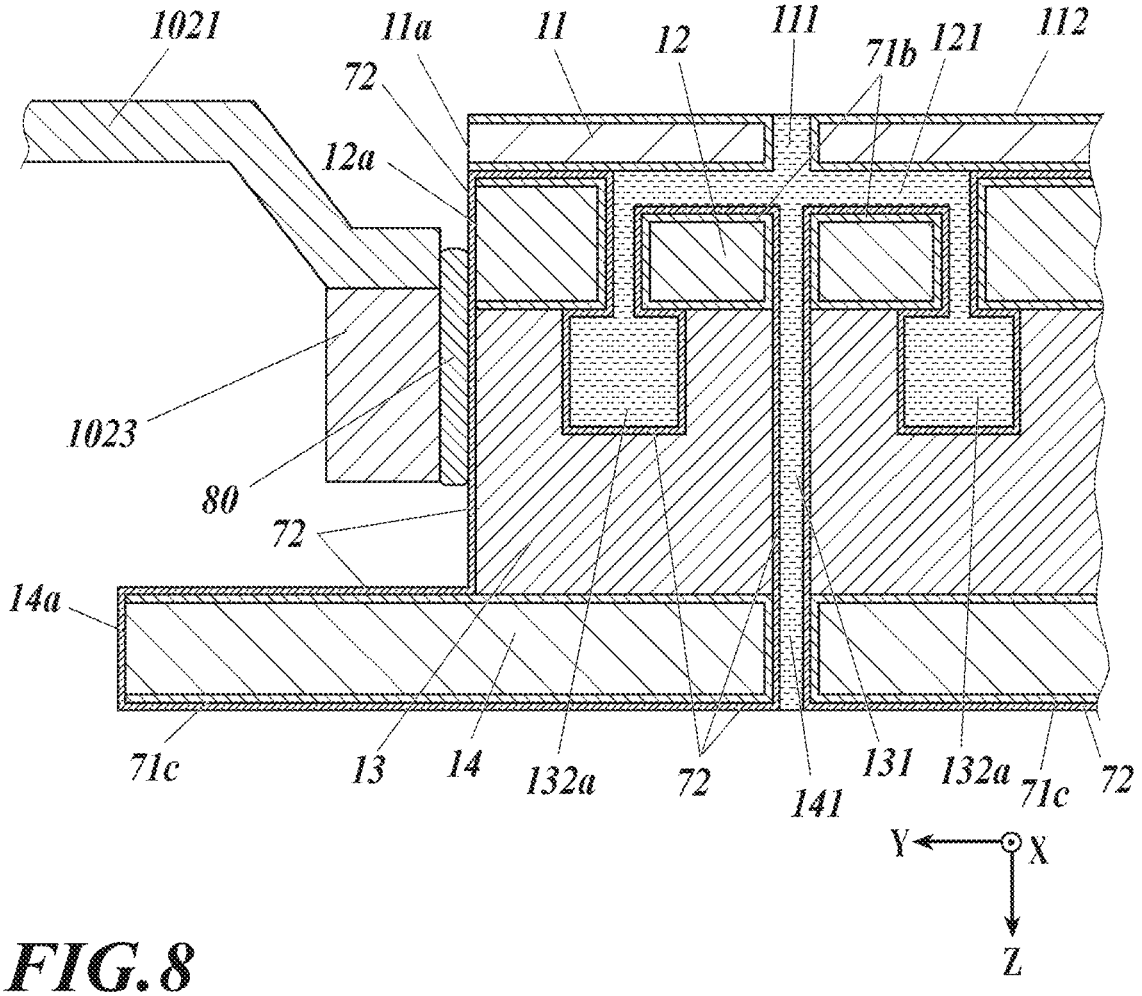
FIG. 7 is a schematic sectional view showing a part of FIG. 6 by enlarging the part.

FIG. 7 is a schematic cross sectional view showing a part of FIG. 6 by enlarging the part. FIG. 7 shows the ink flow path 121 in the flow path spacer substrate 12, the pressure chamber 131 in the pressure chamber substrate 13, and the ink supply port 141 in the wiring substrate 14.

As shown in FIG. 7, a first protective film 71*a* is provided on the surface of the nozzle substrate 11 and the inner wall surface of the nozzle 111. A first protective film 71*b* is provided on the surface of the flow path spacer substrate 12 and the inner wall surface of the ink flow path 121. A first protective film 71*c* is provided on the surface of the wiring substrate 14 and the inner wall surface of the ink supply port 141. When a water-repellent film is provided on the nozzle opening surface 112 of the nozzle substrate 11, the water-repellent film is formed to be overlaid on the first protective film 71*a*.

The first protective films 71*a*, 71*b* and 71*c* are not formed on any of the split face (exposed face 11*a*) which was generated at the time of splitting into the nozzle substrates 11 (splitting into individual pieces) among the lateral surfaces of the nozzle substrate 11, the split face (exposed face 12*a*) which was generated at the time of splitting into the flow path spacer substrates 12 (splitting into individual pieces) among the lateral surfaces of the flow path spacer substrate 12, and the split face (exposed face 14*a*) which was generated at the time of splitting into the wiring substrates 14 (splitting into individual pieces) among the lateral surfaces of the wiring substrate 14. This is because the first protective film 71*a*, 71*b* or 71*c* is formed on each composite substrate having a plurality of regions which forms the nozzle substrates 11, the flow path spacer substrates 12 or the wiring substrates 14, and thereafter the composite substrates are split into the nozzle substrates 11, the flow path spacer substrates 12 and the wiring substrates 14.

Though the first protective films 71*a*, 71*b* and 71*c* are not particularly limited, for example, an organic protective film such as polyparaxylylene, or a protective film formed of an inorganic oxide or an inorganic nitride including at least one of Ti, Al, Zr, Cr, Hf, Ni, Ta and Si can be used. By providing such first protective films 71*a*, 71*b* and 71*c*, it is possible to suppress the occurrence of trouble that the nozzles 111, the ink flow paths 121 and the ink supply ports 141 are corroded by ink, and trouble that the ink adhering to the surfaces of the nozzle substrate 11, the flow spacer substrate 12 and the wiring substrate 14 enters the head chip 10 and erodes the flow paths.

In addition, as shown in FIG. 7, second protective films 72 which are not integrally provided with the first protective films 71*a*, 71*b* and 71*c* are provided on the surface of the layered substrate (hereinafter, referred to as an intermediate layered substrate) which includes the flow spacer substrate 12, the pressure chamber substrate 13 and the wiring substrate 14, and the internal wall surfaces of the ink flow path 121, the pressure chamber 131, the common ink discharge flow path 132, the ink supply port 141 and the discharge hole 142 inside the intermediate layered substrate. Accordingly, the exposed face 12*a* which is not provided with the first protective film 71*b* in the flow path spacer substrate 12 and the exposed face 14*a* which is not provided with the first protective film 71*c* in the wiring substrate 14 are covered with the second protective film 72.

Though the second protective film 72 is not particularly limited, for example, an organic protective film such as polyparaxylylene, or a protective film formed of an inorganic oxide or an inorganic nitride including at least one of Ti, Al, Zr, Cr, Hf, Ni, Ta and Si, similarly to the first protective films 71*a*, 71*b* and 71*c*.

By providing the second protective film 72 in such a way, it is possible to particularly protect the exposed face 12*a* of the flow path spacer substrate 12 which is not provided with the first protective film 71*b* due to the splitting into individual pieces and the exposed face 14*a* of the wiring substrate 14 which is not provided with the first protective film 71*c* due to the splitting into individual pieces. As mentioned above, ink particularly from outside easily adheres to the exposed face 12*a* of the flow path spacer substrate 12 since a part thereof is exposed to the outside of the exterior member 102 without being sealed with the adhesive 80. However, by providing the second protective film 72 on the exposed face 12*a*, it is possible to suppress the occurrence of trouble that the ink enters through an unintended path into the head chip 10 (into the flow path spacer substrate 12) even when the ink adheres to the exposed face 12*a*.

Moreover, it is possible to protect, with the second protective film 72, the surface of the pressure chamber substrate 13 and the inner wall surfaces of the pressure chamber 131 and the common ink discharge flow path 132, on which the first protective film 71 is not provided.

Figure 8:
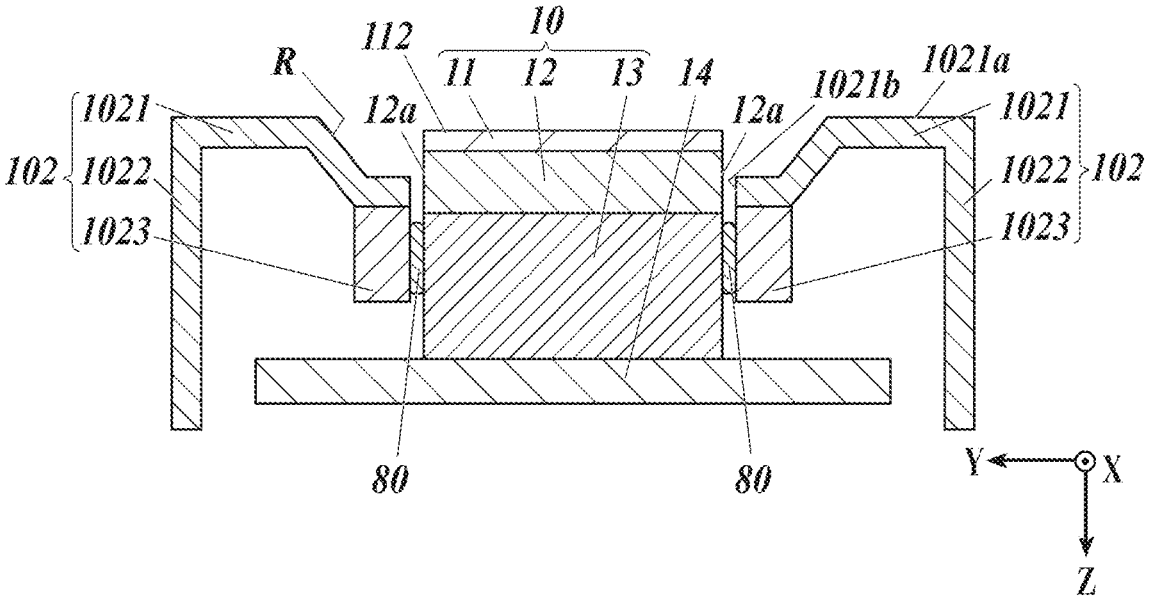
FIG. 8 is a schematic sectional view of a portion including a head chip in an inkjet head.

FIGS. 6 and 7 explains by using an example of providing the adhesive 80 to only a part of the exposed face 12*a* of the flow path spacer substrate 12, and exposing another part of the exposed face 12*a* outside the exterior member 102, however, the present invention is not limited to this. For example, as shown in FIG. 8, the adhesive 80 may be provided in a region not covering the exposed face 12*a* of the flow path spacer substrate 12, so that the entire exposed face 12*a* of the flow path spacer substrate 12 is exposed to the outside of the exterior member 102. That is, a predetermined region excluding at least a part or whole of the exposed face 12*a* of the flow path spacer substrate 12 in the surface of the head chip 10 may be bonded to the exterior member 102 with the adhesive 80. Since the thickness of the flow path spacer substrate 12 and the nozzle substrate 11 is equal to or less than several hundred μm, which is small, the configuration shown in FIG. 8 may be necessary in order to surely prevent the adhesive 80 from reaching the nozzle opening surface 112.

Alternatively, the entire exposed face 12*a* of the flow path spacer substrate 12 may be sealed with the adhesive 80. Also in this case, the ink may enter the interface between the flow path spacer substrate 12 and the adhesive 80 due to the bad bonding, deterioration of the adhesive 80 and the like. However, by providing the second protective film 72 on the exposed face 12*a* of the flow path spacer substrate 12, it is possible to suppress the occurrence of trouble that the ink enters inside the flow path spacer substrate 12.

Next, the manufacturing method of the inkjet head 100 and the manufacturing process related to the manufacturing method will be described.

Figure 9:
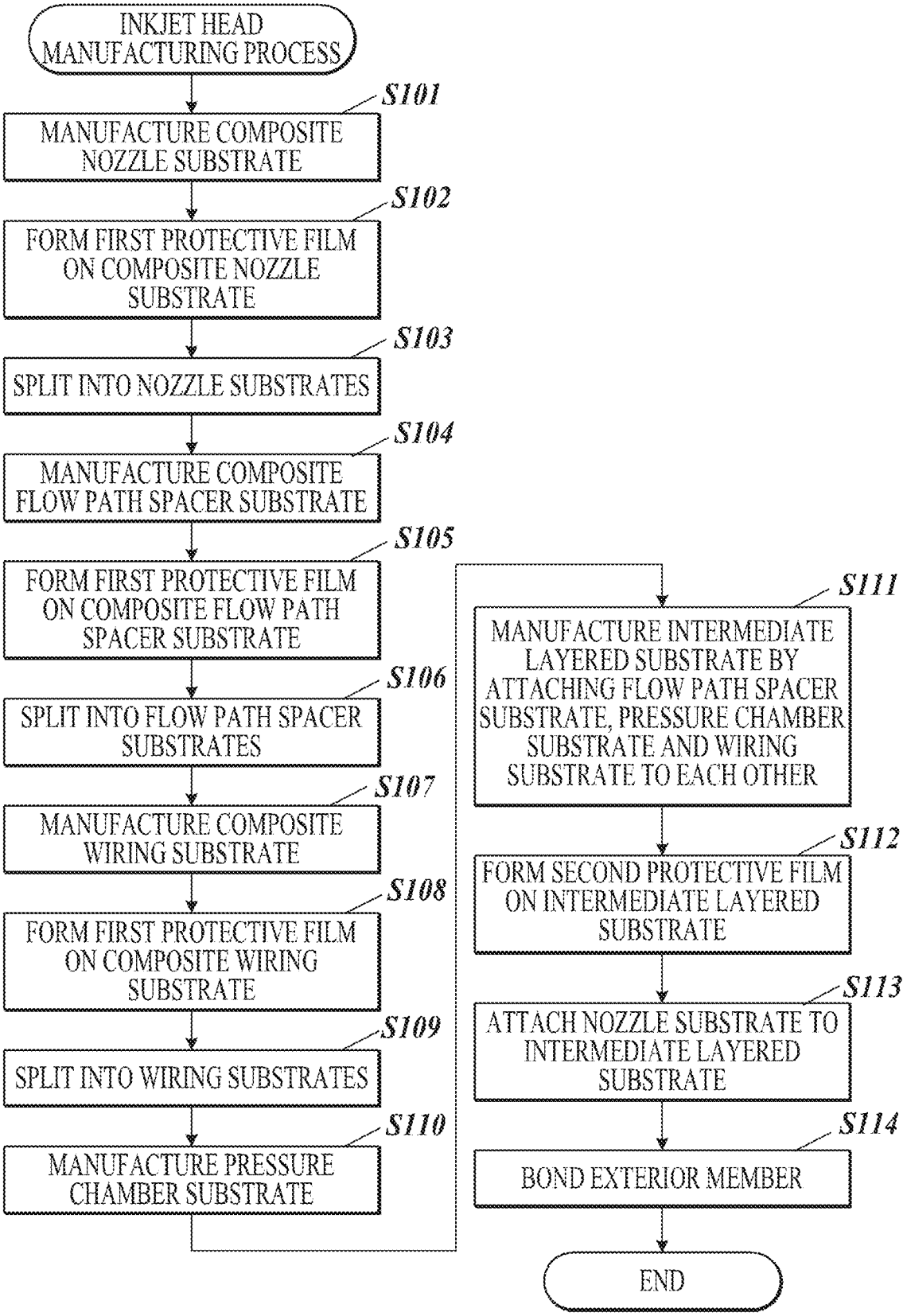
FIG. 9 is a flowchart explaining an inkjet head manufacturing process.

FIG. 9 is a flowchart explaining the manufacturing process of the inkjet head 100.

Figure 10A:
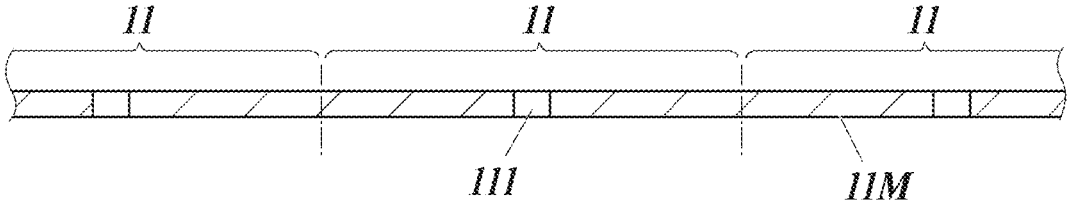
FIG. 10A is a sectional view explaining a nozzle substrate manufacturing method.

In the manufacturing process of the inkjet head 100 in the present embodiment, the composite nozzle substrate 11M having a plurality of regions which forms the nozzle substrates 11 by being split is first manufactured (step S101). That is, as shown in FIG. 10A, the composite nozzle substrate 11M is manufactured by forming the nozzles 111 corresponding to the plurality of nozzle substrates 11 in a silicon substrate.

Figure 10B:
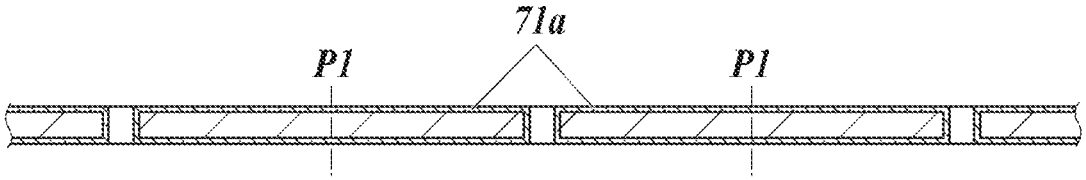
FIG. 10B is a sectional view explaining the nozzle substrate manufacturing method.

Next, the first protective film 71*a* is formed on the surface of the composite nozzle substrate 11M and the inner wall surfaces of the nozzles 111 (step S102) (FIG. 10B). In this step, for example, the vapor deposition method can be used when polyparaxylylene is used as the first protective film 71*a*. When an inorganic oxide or an inorganic nitride including at least one of Ti, Al, Zr, Cr, Hf, Ni, Ta and Si is used as the protective film 71*a*, the CVD method, sputtering method and the like can be used.

Figure 10C:
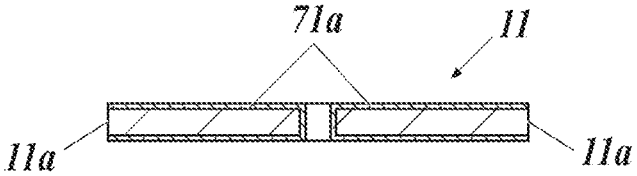
FIG. 10C is a sectional view explaining the nozzle substrate manufacturing method.

Next, by dividing the composite nozzle substrate 11M at dividing positions P1 in FIG. 10B, the composite nozzle substrate 11M is split into a plurality of nozzle substrates 11 (step S103) (FIG. 10C). In this step, any of various splitting methods such as dicing with a blade, cutting with a laser cutter, and scribe break (method combining the scribe of providing a crack in the surface with a knife or the like and the break of extending the crack to break) can be used, for example.

The nozzle substrate 11 manufactured in step S103 is in a state in which the first protective film 71*a* is not formed on the split faces (exposed faces 11*a*) generated by the splitting.

The processes of the above steps S101 to S103 are also hereinafter referred to as the nozzle substrate manufacturing process.

Figure 11A:
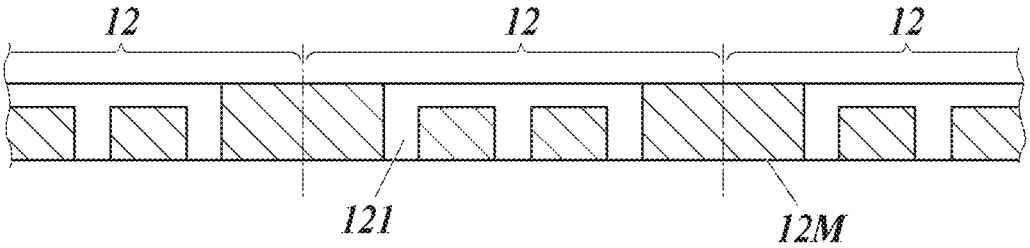
FIG. 11A is a sectional view explaining a flow path spacer substrate manufacturing method.

Next, the composite flow path spacer substrate 12M having a plurality of regions which forms the flow path spacer substrates 12 by being split is manufactured (step S104: composite substrate manufacturing). That is, as shown in FIG. 11A, the composite flow path spacer substrate 12M is manufactured by forming the ink flow paths 121 corresponding to the plurality of flow path spacer substrates 12 in a silicon substrate.

Figure 11B:
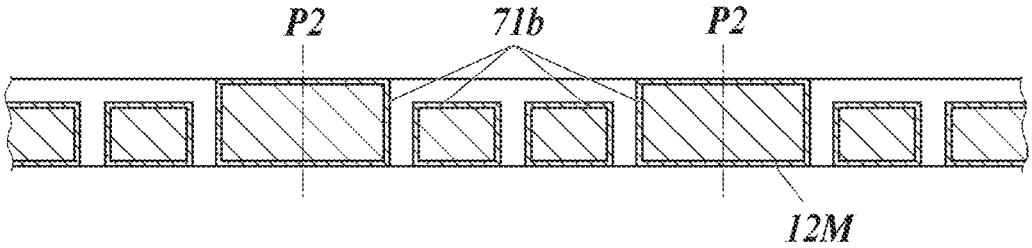
FIG. 11B is a sectional view explaining the flow path spacer substrate manufacturing method.

Next, the first protective film 71*b* is formed on the surface of the composite flow path spacer substrate 12M and the inner wall surfaces of the ink flow paths 121 (step S105: first protective film forming) (FIG. 11B). In this step, the film forming method similar to that of the above-mentioned step S102 can be used.

Figure 11C:
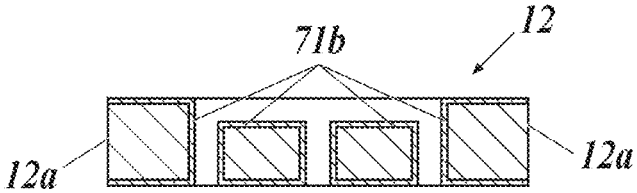
FIG. 11C is a sectional view explaining the flow path spacer substrate manufacturing method.

Next, the composite flow path spacer substrate 12M is split into the plurality of flow path spacer substrates 12 by dividing the composite flow path spacer substrate 12M at dividing positions P2 in FIG. 11B (step S106: splitting) (FIG. 11C). In this step, the splitting method similar to that of the above-mentioned step S103 can be used.

The flow path spacer substrate 12 manufactured in step S106 is in a state in which the first protective film 71*b* is not formed on the split faces (exposed faces 12*a*) generated by the splitting.

The processes of the above steps S104 to S106 are also hereinafter referred to as the flow path spacer substrate manufacturing process.

Next, the composite wiring substrate having a plurality of regions which forms the wiring substrates 14 by being split is manufactured (step S107). That is, the composite wiring substrate is manufactured by forming the ink supply ports 141, discharge holes 142 and wirings 143 corresponding to the plurality of wiring substrates 14 in a silicon substrate. As for the steps S107 to S109 related to the manufacturing of wiring substrate 14, the description of sectional view for the steps is omitted.

Next, the first protective film 71*c* is formed on the surface of the composite wiring substrate and the inner wall surfaces of the ink supply ports 141 and the inner wall surfaces of the discharge holes 142 (step S108). In this step, the film forming method similar to that of the above-mentioned step S102 can be used.

Next, the composite wiring substrate is split into the plurality of wiring substrates 14 by dividing the composite wiring substrate at predetermined dividing positions (step S109). In this step, the splitting method similar to that of the above-mentioned step S103 can be used.

The wiring substrate 14 manufactured in step S109 is in a state in which the first protective film 71*c* is not formed on the split faces (exposed face 14*a* (FIG. 7)) generated by the splitting.

The processes of the above steps S107 to S109 are also hereinafter referred to as the wiring substrate manufacturing process.

Next, the pressure chamber substrate 13 is manufactured by forming the pressure chambers 131, the common ink discharge flow paths 132, the drive electrodes 133 and the connection electrodes 135 in the substrate formed of a piezoelectric body (step S110). In this step S110, similarly to the above-mentioned other substrates, a composite substrate having a plurality of regions which forms pressure chamber substrates 13 by being split may be divided into individual pieces of the plurality of pressure chamber substrates 13, or each of the pressure chamber substrates 13 may be manufactured separately. The process in this step S110 is also hereinafter referred to as the pressure chamber substrate manufacturing process.

The orders of executing the above mentioned nozzle substrate manufacturing process, flow path spacer substrate manufacturing process, wiring substrate manufacturing process and the pressure chamber substrate manufacturing process may be reversed to each other, or at least parts of the processes may be performed parallel to each other.

Figure 12A:
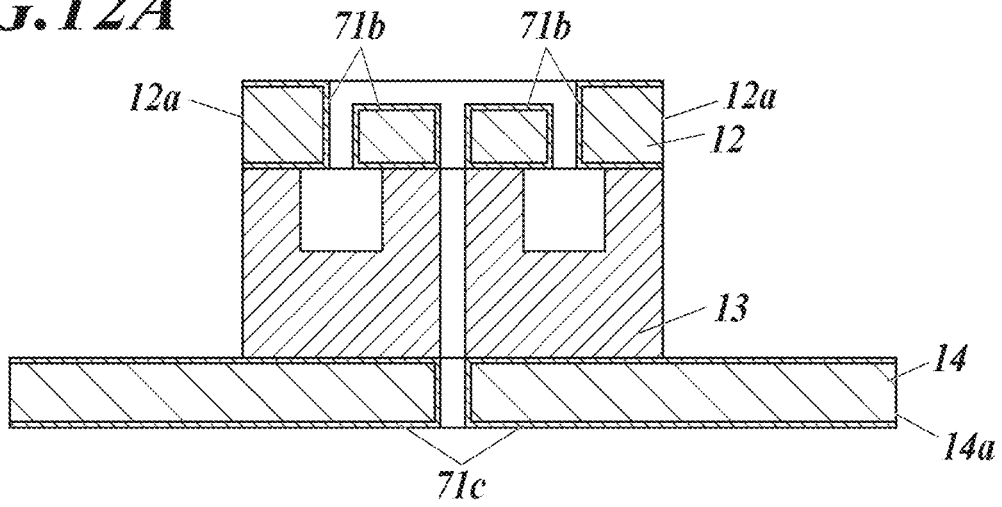
FIG. 12A is a sectional view explaining an inkjet head manufacturing method.

Next, as shown in FIG. 12A, the intermediate layered substrate is manufactured by attaching the flow path spacer substrate 12, the pressure chamber substrate 13 and the wiring substrate 14 to each other via the adhesive (step S111).

Figure 12B:
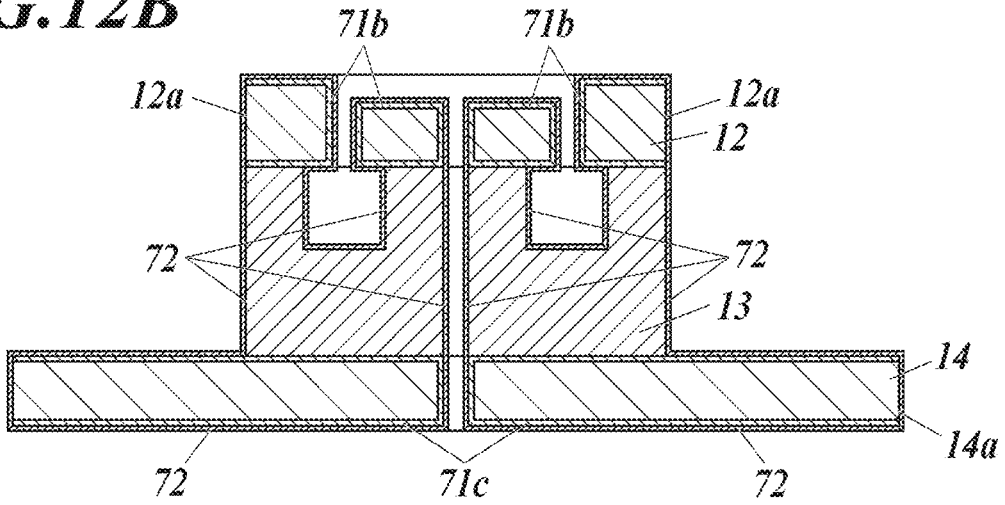
FIG. 12B is a sectional view explaining the inkjet head manufacturing method.

Next, as shown in FIG. 12B, the second protective film 72 is formed on the surface of the intermediate layered substrate, and the inner wall surfaces of the ink flow paths 121, pressure chambers 131, the common ink discharge flow paths 132, the ink supply ports 141 and the discharge holes 142 (step S112: second protective film forming). In this step, the film forming method similar to that of the above-mentioned step S102 can be used.

Figure 12C:
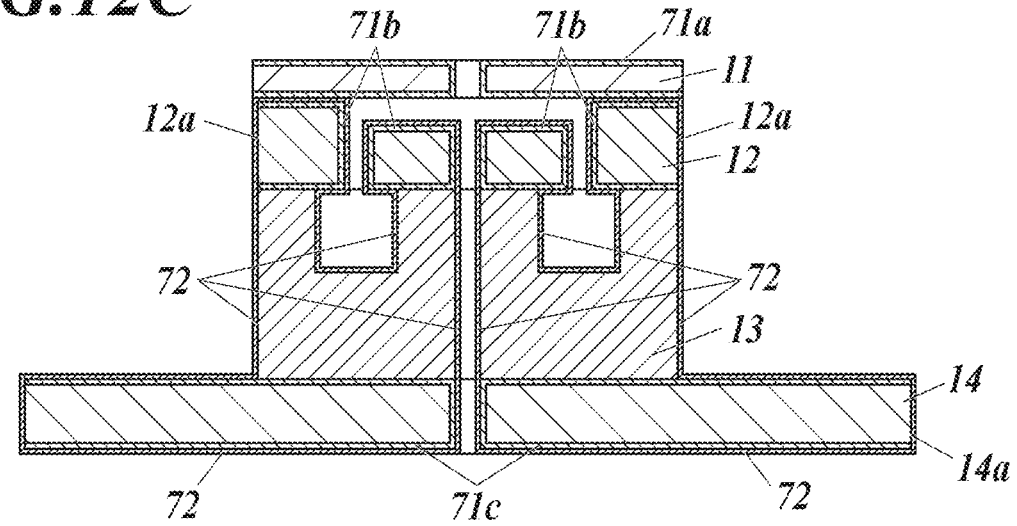
FIG. 12C is a sectional view explaining the inkjet head manufacturing method.

Next, as shown in FIG. 12C, the head chip 10 is manufactured by fixing the nozzle substrate 11 to the intermediate layered substrate via the adhesive (step S113: nozzle substrate fixing). The obtained head chip 10 and the exterior member 102 are bonded via the adhesive 80 (step S114: exterior member bonding), the other components are incorporated into the housing 101 and the exterior member 102, and then the inkjet head 100 is completed.

Modification Example

A modification example of the first embodiment will be described. The modification example is different from the above embodiment in the surface where the second protective film 72 is formed. Hereinafter, the difference from the above embodiment will be described.

Figure 13:
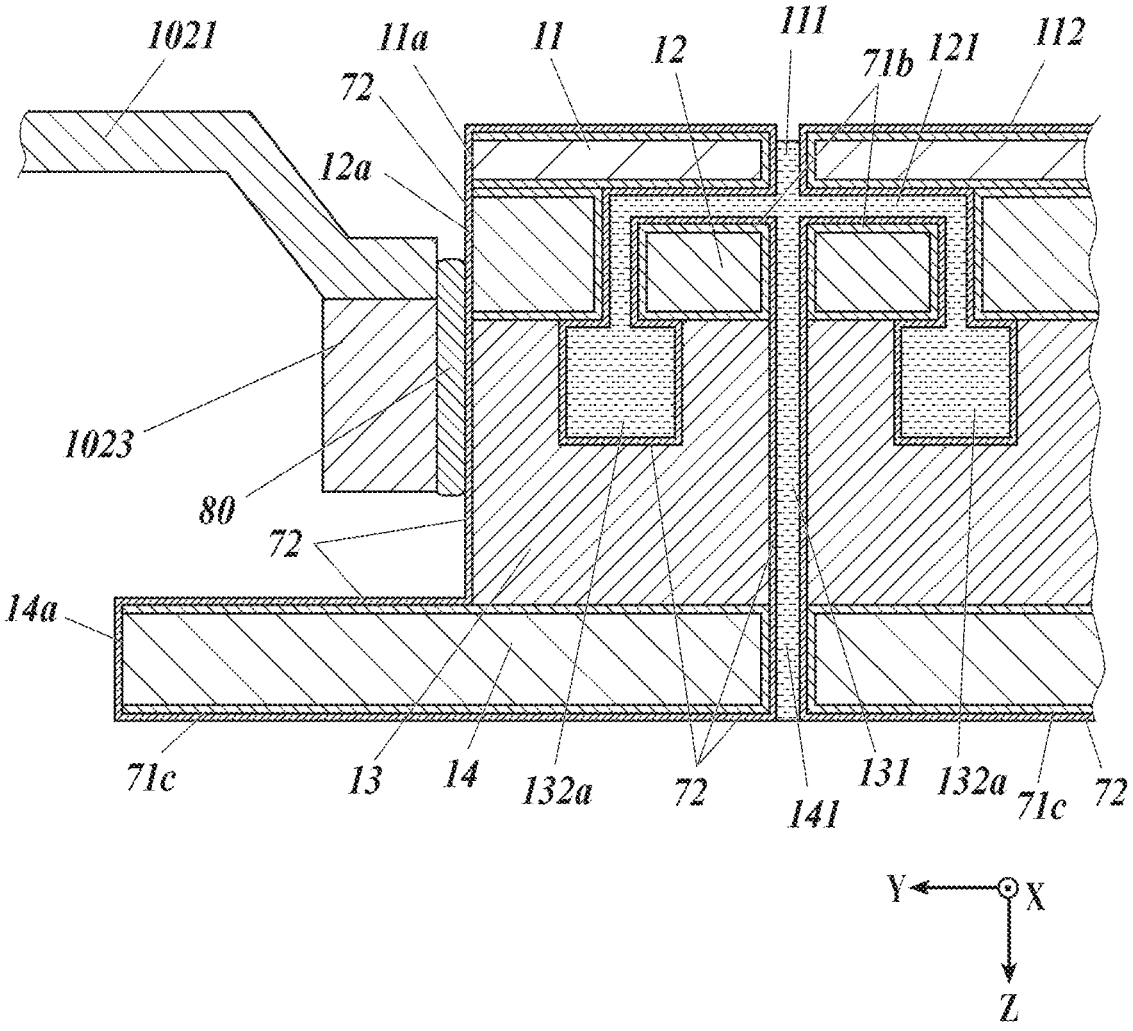
FIG. 13 is an enlarged schematic sectional view of an inkjet head according to a modification example of a first embodiment.

FIG. 13 is an enlarged schematic sectional view of the inkjet head 100 according to the modification example.

As shown in this figure, in the modification example, the second protective film 72 is formed on the entire surface of the layered substrate including the head chip formed of the nozzle substrate 11, the flow path spacer substrate 12 and the pressure chamber substrate 13, and the wiring substrate 14. Accordingly, the second protective film 72 is also formed on the inner wall surfaces of the nozzles 111 and the split faces (exposed faces 11*a*) generated by the splitting of the composite nozzle substrate 11M among the lateral surfaces of the nozzle substrate 11.

When a water-repellent film is provided to the nozzle opening surface 112 in the modification example, the water-repellent film may be formed to be overlaid on the second protective film 72 provided on the nozzle opening surface 112 of the nozzle substrate 11.

Figure 14:
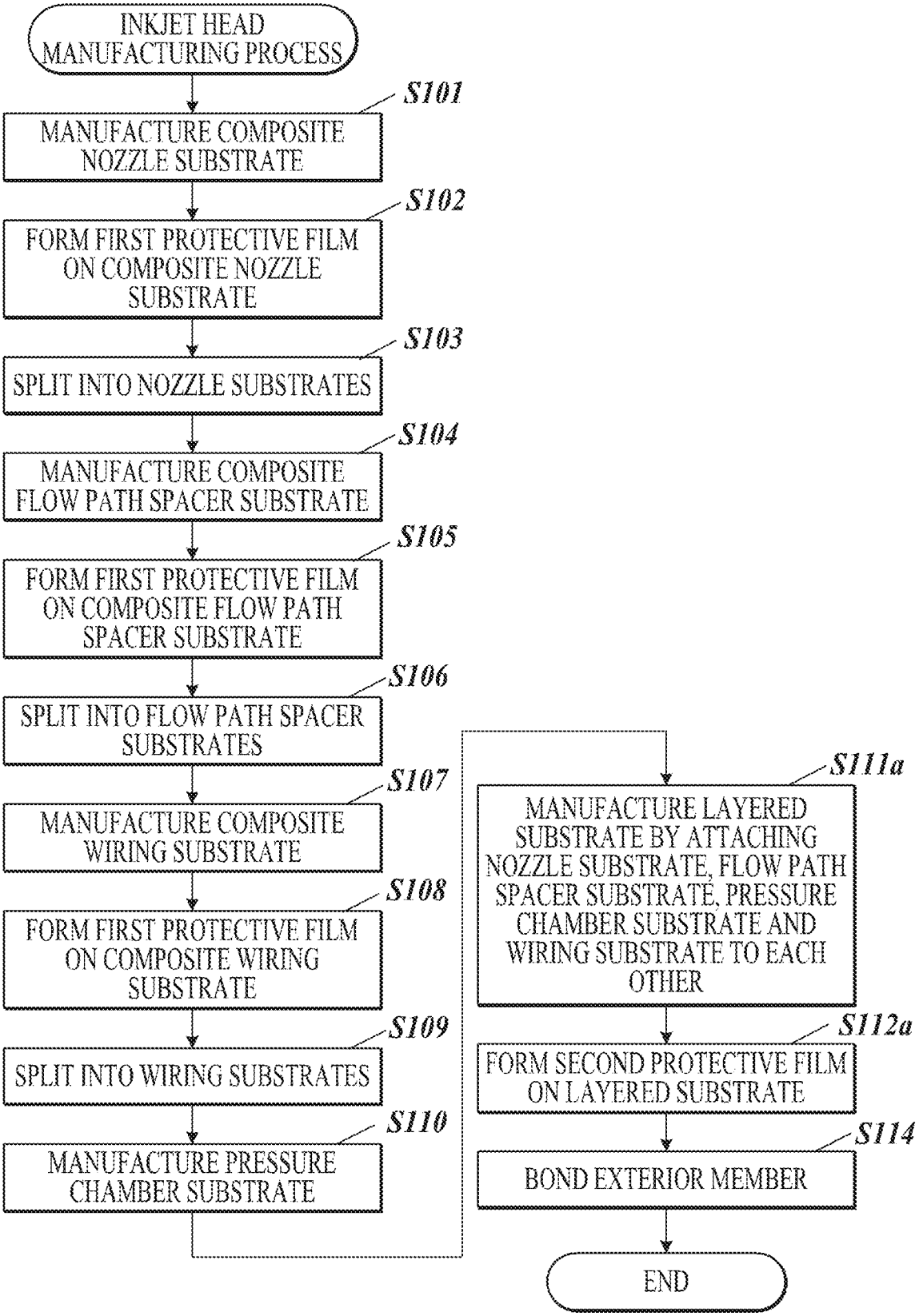
FIG. 14 is a flowchart explaining an inkjet head manufacturing process according to the modification example of the first embodiment.

FIG. 14 is a flowchart showing a manufacturing process of the inkjet head 100 in the modification example.

The flowchart in FIG. 14 is obtained by changing the steps S111 and S112 in the flowchart in FIG. 9 of the above embodiment to steps S111*a* and S112*a* and deleting the step S113. Hereinafter, the difference from the flowchart in FIG. 9 will be described.

In the manufacturing process of the inkjet head 100 in the modification example, after the nozzle substrate manufacturing process, the flow path spacer substrate manufacturing process, the wiring substrate manufacturing process and the pressure chamber substrate manufacturing process (step S101 to S110) are finished, the layered substrate is manufactured by attaching the nozzle substrate 11, the flow path spacer substrate 12, the pressure chamber substrate 13 and the wiring substrate 14 to each other via the adhesive (step S111*a*: nozzle substrate fixing). Then, the second protective film 72 is formed on the obtained layered substrate (step S112*a*: second protective film forming), thereafter, the exterior ember 102 is bonded to the head chip 10 (step S114: exterior member bonding), and the inkjet head 100 is completed.

As described above, the manufacturing method of the inkjet head 100 in the present embodiment is a manufacturing method for an inkjet head 100 that includes a head chip 10 including: nozzles 111 that eject ink; and a flow path spacer substrate 12 including ink flow paths 121 which communicate with the nozzles 111 and through which the ink flows, the method including: composite substrate manufacturing that is manufacturing a composite flow path spacer substrate 12M including a plurality of regions which forms flow path spacer substrates 12 by being split, each of the flow path spacer substrates 12 being the flow path spacer substrate 12; first protective film forming that is forming a first protective film 71*a* on a surface of the composite flow path spacer substrate 12M and inner wall surfaces of the ink flow paths 121;

splitting that is splitting the composite flow path spacer substrate 12M into the flow path spacer substrates 12; and second protective film forming that is forming a second protective film 72 on at least exposed faces 12*a* in split faces of the flow path spacer substrates 12 generated in the splitting, the exposed faces 12*a* being exposed in a surface of the head chip 10.

Though the first protective film 71*a* is not provided on the split faces of the flow path spacer substrates 12 generated in the above splitting, the exposed faces 12*a* can be protected by providing the second protective film 72 on the split faces (exposed faces 12*a*) exposed in the surface of the head chip 10 as in the manufacturing method of the present embodiment. Thus, it is possible to suppress the occurrence of trouble that the ink adhering to any split face corrodes the flow path spacer substrate 12 and enters the flow path spacer substrate 12 even when the split face of the flow path spacer substrate 12 generated by the splitting into individual pieces is exposed in the surface of the head chip 10. Furthermore, according to the above manufacturing method, since it is possible to cover the inner wall surfaces of the ink flow paths 121 of the flow path spacer substrate 12 with the first protective film 71*a*, it is possible to suppress the occurrence of trouble that any ink flow path 121 is corroded by the ink flowing through the ink flow path 121.

Though the above description describes the effect focusing on the flow path spacer substrate 12, the above embodiment also obtains the same effect for the wiring substrate 14. That is, also in the wiring substrate 14, since exposed faces 14*a* which are the split faces exposed in the surface of the head chip 10 can be covered with the second protective film 72, it is possible to suppress the occurrence of trouble that the ink adhering to any split face corrodes the wiring substrate 14 even when the split face is exposed in the surface of the head chip 10. Moreover, since the inner wall surfaces of the ink supply ports 141 and the discharge holes 142 as the ink flow path for the ink to flow can be covered with the first protective film 71*c*, it is possible to suppress the occurrence of trouble that any of the ink supply ports 141 and the discharge holes 142 is corroded by the ink.

The head chip manufacturing includes nozzle substrate fixing that is directly or indirectly fixing a nozzle substrate 11, in which openings of the nozzles 111 are provided, to the flow path spacer substrate 12 after the second protective film forming. By such a method, it is possible to efficiently manufacture the head chip 10 having the exposed faces 12*a* of the flow path spacer substrates 12 covered with the second protective film 72 when it is not necessary to provide the second protective film 72 on the surface of the nozzle substrate 11.

The above modification example includes nozzle substrate fixing that is directly or indirectly fixing a nozzle substrate 11, in which openings of the nozzles 111 are provided, to the flow path spacer substrate 12 before the second protective film forming, and the second protective film 72 is formed on a surface of an intermediate layered substrate including the flow path spacer substrate 12 and the nozzle substrate 11 in the second protective film forming. Thus, since the second protective film 72 is provided on the entire surface of the intermediate layered substrate, it is possible to more surely suppress the occurrence of trouble that the ink adhering from outside corrodes the portion corresponding to the intermediate layered substrate in the head chip 10. That is, in the modification example, since the exposed face 11*a* exposed in the surface of the head chip 10 in the split face generated by the splitting into individual pieces is protected by the second protective film 72 also for the nozzle substrate 11, it is possible to suppress the occurrence of trouble that the ink adhering to the exposed face 11*a* of the nozzle substrate 11 corrodes the nozzle substrate 11.

The manufacturing method of inkjet head 100 in the above embodiment includes exterior member bonding that is bonding an exterior member 102 to the head chip 10 including the nozzle substrate 11 and the flow path spacer substrate 12 with an adhesive 80 after the second protective film forming, the exterior member 102 covering a part of the head chip 10 with a nozzle opening surface 112 exposed, and the nozzle opening surface 112 including the openings of the nozzles 111 in the nozzle substrate 11. A predetermined region excluding at least a part or whole of each of the exposed faces 12*a* of the flow path spacer substrate 12 in the surface of the head chip is bonded to the exterior member 102 with the adhesive 80 in the exterior member bonding.

In this method, since a part of the exposed face 12*a* of the flow path spacer substrate 12 is exposed outside the exterior member 102 without being covered with the adhesive 80, the ink easily adheres especially from outside. However, by providing the second protective film 72 on the exposed face 12*a*, it is possible to suppress the occurrence of trouble that the flow path spacer substrate 12 is corroded by ink even when the ink adheres to the exposed face 12*a*. The adhesive 80 coming to the nozzle opening surface 112 influences the ink ejection from the nozzles 111 and leads to the occurrence of trouble that the recording medium M facing the nozzle opening surface 112 contacts the adhesive 80. However, bonding the predetermined region to the exterior member 102 with the adhesive 80 enables more surely providing the adhesive 80 to only the lateral surface of the head chip 10, and thus it is possible to suppress the occurrence of the above trouble.

The exterior member 102 includes a recess R, an exposing through hole 1021*b* including an opening in an inner wall surface of the recess R is provided in the exterior member 102, and in the exterior member bonding, the exterior member 102 is bonded to the head chip 10 such that a portion including the nozzle opening surface 112 and at least a part of the exposed face 12*a* of the flow path spacer substrate 12 in the head chip 10 protrudes outside the exterior member 102 from the opening of the exposing through hole 1021*b*. Thus, it is possible to make a wiping member easily contact the nozzle opening surface 112 when the exterior member 102 (top board 1021) and the nozzle opening surface 112 are wiped with the wiping member.

The first protective film 71*a* is an inorganic oxide or an inorganic nitride that includes at least one of Ti, Al, Zr, Cr, Hf, Ni, Ta and Si, or polyparaxylylene. By such a configuration, it is possible to more surely suppress the occurrence of trouble that the flow path spacer substrate 12 is corroded by the ink.

The second protective film 72 is an inorganic oxide or an inorganic nitride that includes at least one of Ti, Al, Zr, Cr, Hf, Ni, Ta and Si, or polyparaxylylene. By such a configuration, it is possible to more surely suppress the occurrence of trouble that the flow path spacer substrate 12 is corroded by the ink.

The flow path spacer substrate 12 is made of Si, metal or glass. Since the flow path spacer substrate 12 of such a configuration has a flat surface, it is possible to protect the surface without any gap with the first protective film 71*a* and the second protective film 72, and process the ink flow path 121 easily.

The manufacturing method of the inkjet recording device 1 in the present embodiment includes the above manufacturing method of the inkjet head 100. Thus, it is possible to manufacture the inkjet recording device 1 which does not easily cause the trouble that the flow path spacer substrate 12 of the inkjet head 100 is corroded by the ink.

The inkjet head 100 in the present embodiment is an inkjet head 100 which includes a head chip 10 including: nozzles 111 that eject ink; and a flow path spacer substrate 12 including ink flow paths 121 which communicate with the nozzles 111 and through which the ink flows. The flow path spacer substrate 12 includes lateral surfaces in which openings of the ink flow paths 121 are not provided, a first protective film 71*a* is provided on a surface excluding at least a part of the lateral surfaces of the flow path spacer substrate 12 and on inner wall surfaces of the ink flow paths 121, at least a part of the portion where the first protective film 72*a* is not provided in the lateral surfaces is an exposed face 12*a* that is exposed in a surface of the head chip 10, and a second protective film 72 that is not integrally formed with the first protective film 71*a* is provided on the exposed face 12*a*.

By such a configuration, it is possible to suppress the occurrence of trouble that the ink flow path 121 is corroded by the ink since the first protective film 71*a* is provided on the flow path spacer substrate 12.

Moreover, the first protective film 71*a* is not provided on at least a part of the lateral surfaces of the flow path spacer substrate 12, and at least a part (exposed face 12*a*) of the portion where the first protective film 71*a* is not provided is exposed in the surface of the head chip 10. Such an exposed face 12*a* is generated when the split face obtained by splitting the composite flow path spacer substrate 12M into the flow path spacer substrates 12 is exposed in the surface of the head chip 10 as in the present embodiment. By the above configuration, since the second protective film 72 is provided on the exposed face 12*a*, it is possible to suppress the occurrence of trouble that the ink adhering to the exposed face 12*a* of the flow path spacer substrate 12 corrodes the exposed face 12*a* and enters the flow path spacer substrate 12.

Though the above description describes the effect focusing on the flow path spacer substrate 12, the above embodiment also obtains the same effect for the wiring substrate 14.

The portion where the first protective film 71*a* is not provided in the lateral surfaces of the flow path spacer substrate 12 is a split face that is generated in splitting a composite flow path spacer substrate 12M into flow path spacer substrates 12, the composite flow path spacer substrate 12M including a plurality of regions which forms flow path spacer substrates 12 by being split. The second protective film 72*a* is provided on the exposed face 12*a*, which is exposed in the surface of the head chip 10, in the split face. Thus, it is possible to suppress the occurrence of trouble that the ink enters the flow path spacer substrate 12 when the flow path spacer substrate 12 is manufactured by splitting the composite flow path spacer substrate 12M.

In the above modification example, the head chip 10 includes a nozzle substrate 11 in which openings of the nozzles 111 is provided, and the second protective film 72 is provided on the surface of an intermediate layered substrate including the flow path spacer substrate 12 and the nozzle substrate 11. Thus, it is possible to more surely suppress the occurrence of trouble that the ink adhering from outside enters the portion corresponding to the intermediate layered substrate in the head chip 10.

The head chip 10 includes the nozzle substrate 11 in which the openings of the nozzles 111 are provided, and the inkjet head 100 includes an exterior member 102 that covers a part of the head chip 10 with a nozzle opening surface 112 exposed, the nozzle opening surface 112 including the openings of the nozzles 111 in the nozzle substrate 11. A predetermined region excluding at least a part or whole of the exposed face 12*a* of the flow path spacer substrate 12 in the surface of the head chip 10 is bonded to the exterior member 102 with an adhesive 80. Thus, it is possible to surely protect the exposed face 12*a* of the flow path spacer substrate 12 which is exposed outside the exterior member 102 in such a configuration, with the second protective film 72. It is also possible to more surely provide the adhesive 80 to only the lateral surface of the head chip 10.

The exterior member 102 includes a recess R, an exposing through hole 1021*b* including an opening in an inner wall surface of the recess R is provided in the exterior member 102, and a portion including the nozzle opening surface 112 and at least a part of the exposed face 12*a* of the flow path spacer substrate 12 in the head chip 10 protrudes outside the exterior member 102 from the opening of the exposing through hole 1021*b*. By such a configuration, it is possible to make the wiping member easily contact the nozzle opening surface 112 when the exterior member 102 (top board 1021) and nozzle opening surface 112 are wiped with a wiping member such as a wiping cloth.

The inkjet recording device 1 in the present embodiment includes the above inkjet head 100. Thus, it is possible to more surely suppress the corrosion of the flow path spacer substrate 12 by the ink.

Second Embodiment

Next, a second embodiment of the present invention will be described. The present embodiment is different from the first embodiment in the respect of using a head chip 10 of the so-called bend mode type which ejects ink by changing the vibration plate that forms the wall surface of pressure chamber by deformation of piezoelectric element. Hereinafter, the description will be made mainly for the difference from the first embodiment.

Figure 15:
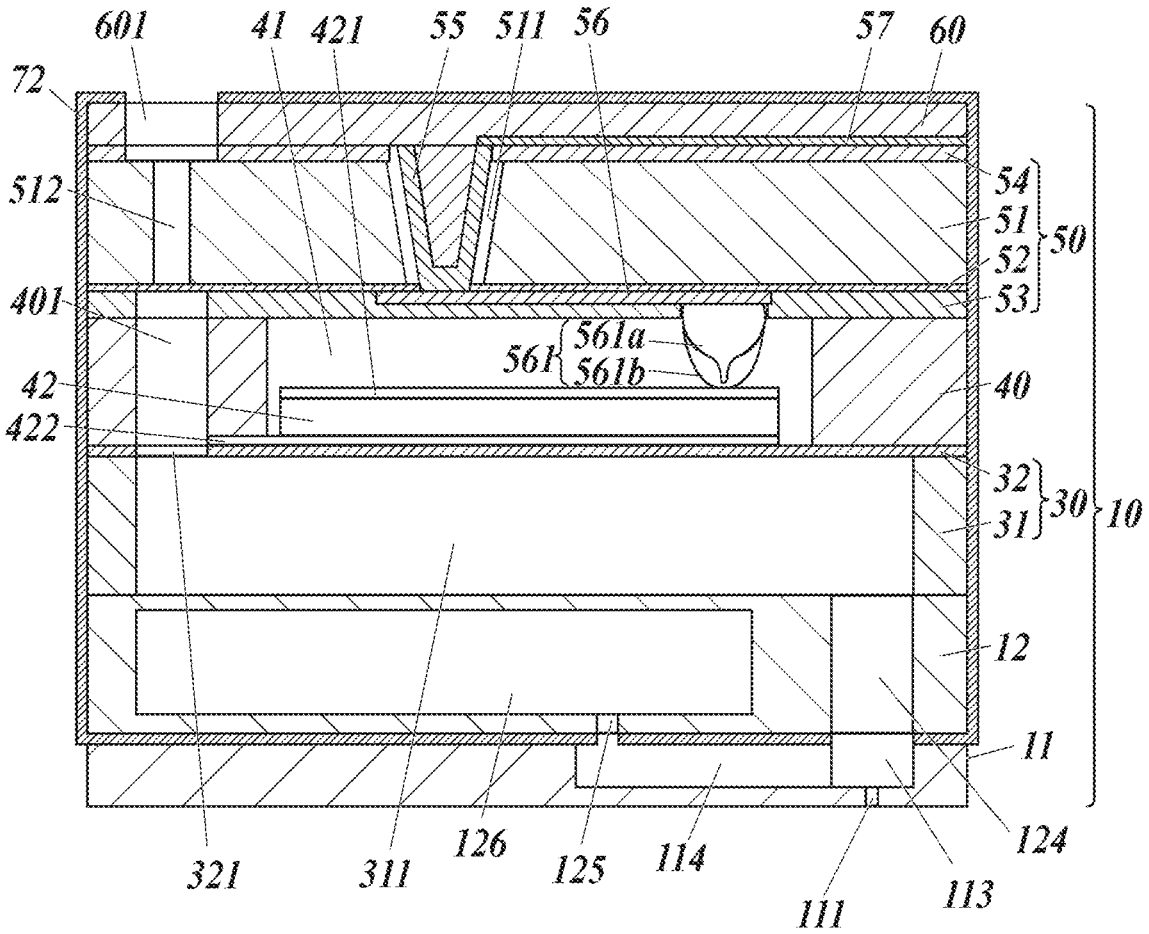
FIG. 15 is a schematic sectional view showing the head chip in the present embodiment.

FIG. 15 is a schematic sectional view showing the head chip 10 in the present embodiment.

The head chip 10 in the present embodiment has a structure including a nozzle substrate 11, a flow path spacer substrate 12, a vibration substrate 30, a piezoelectric element spacer substrate 40, a wiring substrate 50 and a protective layer 60 which are layered in order from the lower side.

The nozzle substrate 11 includes a nozzle 111, a large diameter portion 113 which is a hole communicating with the nozzle 111 and having a diameter larger than that of the nozzle 111, and an individual ink discharge flow path 114 provided to diverge from the large diameter portion 113 and used for ink discharge.

The flow path spacer substrate 12 includes a large diameter portion 124 which is communicating with the large diameter portion 113, a diaphragm portion 125 which is communicating with the individual ink discharge flow path 114, and a common ink discharge flow path 126 which is communicating with the diaphragm portion 125.

The common ink discharge flow path 126 extends in a direction orthogonal to the drawing, and is connected to a plurality of individual ink discharge flow paths 114 diverging from a plurality of nozzles 111. The common ink discharge flow path 126 includes a through hole not shown in the drawings and running from the flow path spacer substrate 12 to the upper most surface of the head chip 10, to allow the ink to be discharged from the through hole to the outlet 103*b* (or outlet 103*c*).

The vibration substrate 30 includes a pressure chamber layer 31 formed on a silicon substrate on which a pressure chamber 311 communicating with the large diameter portion 124 is provided, and a vibration plate 32. The vibration plate 32 is layered on the upper surface of the pressure chamber layer 31 to cover the opening on the upper side of the pressure chamber 311, and forms an upper wall portion of the pressure chamber 311. In the vibration plate 32, a through hole 321 communicating with the pressure chamber 311 and running in the upward direction is formed.

The piezoelectric element spacer substrate 40 is a substrate formed of 42 alloy and is a layer forming the space 41 for containing the piezoelectric elements 42 and the like between the vibration plate 32 and the wiring substrate 50.

The piezoelectric element 42 has a shape nearly same as the shape of the pressure chamber 311 in a plan view, and is provided at the position facing the pressure chamber 311 across the vibration plate 32. The piezoelectric element 42 is an actuator formed of a piezoelectric body (PZT in the embodiment) for deforming the vibration plate 32. The two electrodes 421 and 422 are respectively provided on the upper and lower surfaces of the piezoelectric element 42, and the electrode 422 on the lower surface side is fixed to the vibration plate 32.

In the piezoelectric element spacer substrate 40, the through hole 401 communicating with the through hole 321 of vibration palate 32 and running in the upward direction is formed independently from the space 41.

The wiring substrate 50 includes an interposer 51 which is a substrate made of silicon. The lower surface of the interposer 51 is coated with two layers which are insulation layers 52 and 53 of silicon oxide. The upper surface is also coated with an insulation layer 54 of silicon oxide. The insulation layer 53 located lower among the insulation layers 52 and 53 is layered on the upper surface of the piezoelectric element spacer substrate 40.

A through hole 511 running in the upward direction is formed in the interposer 51, and a through electrode 55 is inserted in this through hole 511. One end of the wiring 56 extending in the horizontal direction is connected to the lower end of the through electrode 55.

The other end of this wiring 56 is connected above the electrode 421 of the upper surface of the piezoelectric element 42 via a connector 561. The connector 561 is formed of a stud bump 561*a* provided on the lower surface of the wiring 56 and a conductive material 561*b* which is formed by being applied to the lower end side of the stud bump 561*a*.

An individual wiring 57 is connected to the upper end of the through electrode 55, and the individual wiring 57 extends in the horizontal direction and connected to a wiring member formed of FPC or the like. A drive signal is supplied to the piezoelectric element 42 via the wiring member and the individual wiring 57 from the drive circuit connected to the wiring member.

A through hole 512 communicating with the through hole 401 of the piezoelectric element spacer substrate 40 and running in the upward direction is formed in the interposer 51. Among the insulation layers 52 to 54, each portion coating the portion near the through hole 512 is formed to have an opening diameter larger than that of the through hole 512.

The protective layer 60 is a layer protecting the individual wiring 57, and layered on the upper surface of the insulation layer 54 of the interposer 51 while covering the individual wiring 57 provided on the upper surface of the wiring substrate 50. In the protective layer 60, an ink inflow port 601 communicating with the through hole 512 is formed.

Hereinafter, the piezoelectric element spacer substrate 40, the wiring substrate 50 and the protective layer 60 will be also collectively referred to as an actuator unit.

In the head chip 10 in the present embodiment having such a configuration, the ink supplied from the ink inflow port 60 flows through the through holes 512 and 401 and pressure chambers 311 in order, to be pooled in the pressure chamber 311. At the time of ink ejection, the ink flows through the large diameter portion 124, the large diameter portion 113 and the nozzle 111 in order. A part of the ink flowing in the large diameter portion 113 is discharged outside through the individual ink discharge flow path 114 and the common ink discharge flow path 126.

In the head chip 10 in the present embodiment, a first protective film not shown in the drawings is provided on the surface and the inner wall surface of the flowing path of ink for each of the nozzle substrate 11, the flow path spacer substrate 12 and the vibration substrate 30. The second protective film 72 is formed on the surface of the intermediate layered substrate which is formed of the flow path spacer substrate 12, the vibration substrate 30, the piezoelectric element spacer substrate 40, the wiring substrate 50 and the protective layer 60. As the first protective film and the second protective film 72, the materials similar to those of the above embodiment can be used.

Figure 16:
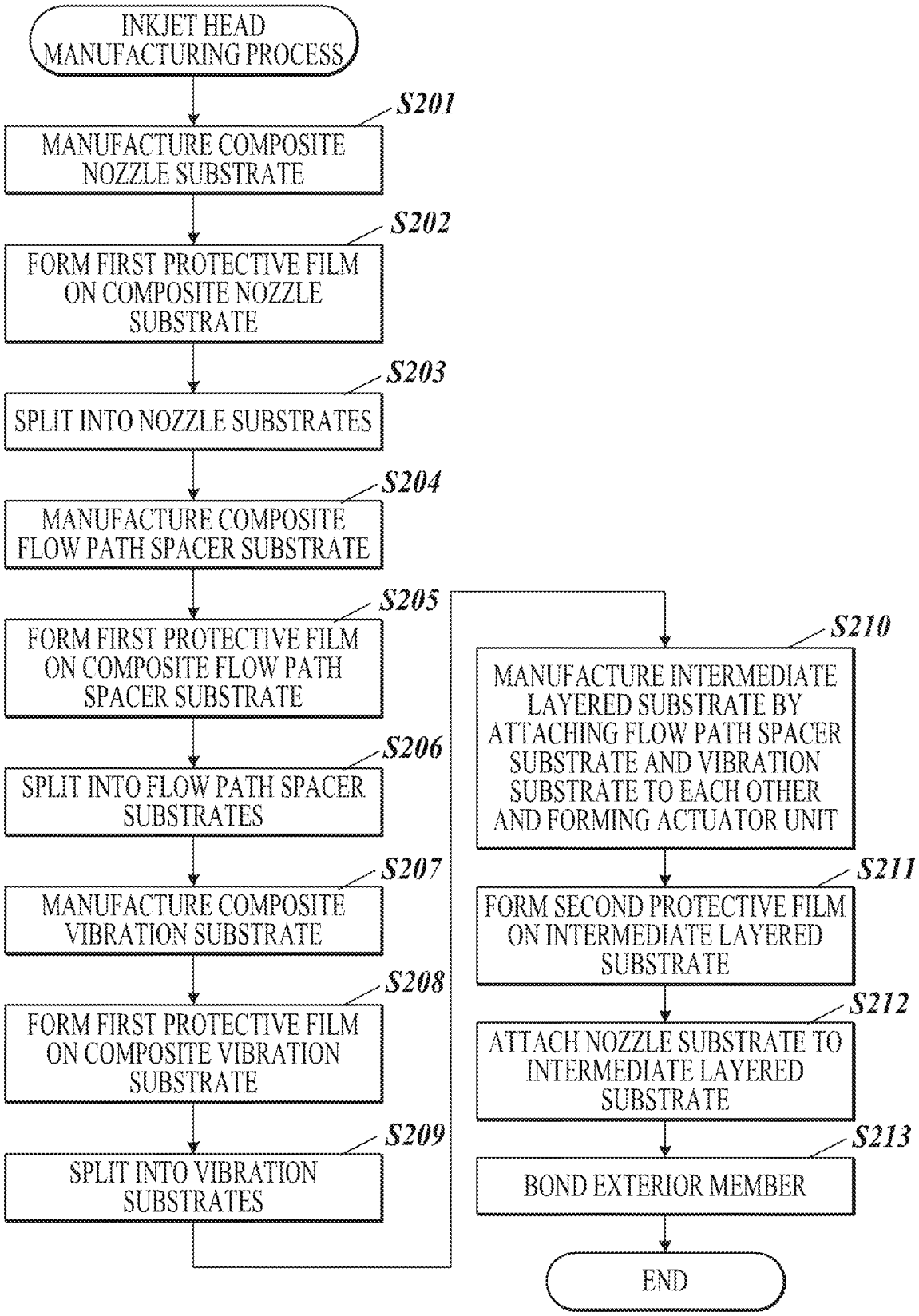
FIG. 16 is a flowchart explaining an inkjet head manufacturing process in a second embodiment.

FIG. 16 is a flowchart for explaining the manufacturing process of inkjet head 100 in the second embodiment.

In the manufacturing process of inkjet head 100 in the present embodiment, the nozzle substrates 11 are first manufactured by splitting a composite nozzle substrate 11M, which has the first protective film formed on its surface, into the nozzle substrates 11 by the process similar to that of the nozzle substrate manufacturing process in the first embodiment (step S201 to S203). In the present embodiment, in addition to the nozzle 111, the large diameter portion 113 and the individual ink discharge flow path 114 are formed in the nozzle substrate 11.

Next, the flow path spacer substrate 12 is manufactured by splitting the composite flow path spacer substrate 12M, which has the first protective film formed on its surface, into the flow path spacer substrates 12 by the process similar to that of the flow path spacer substrate manufacturing process in the first embodiment (steps S204 to S206: composite substrate manufacturing, first protective film forming, and splitting). In the present embodiment, the large diameter portion 124, the diaphragm portion 125 and the common ink discharge flow path 126 are formed in the flow path spacer substrate 12.

A composite vibration substrate having a plurality of regions which forms vibration substrates 30 by being split is then manufactured (step S207). That is, in the silicon substrate, pressure chambers 311 corresponding to a plurality of vibration substrates 30 are formed, and the vibration plate 32 is attached to manufacture the composite vibration substrate.

The first protective film is formed on the surface of the composite vibration substrate and the inner wall surfaces of the pressure chambers 311 (step S208). In this step, the film forming method which is same as that of step S202 can be used.

The composite vibration substrate is split into a plurality of vibration substrates 30 by dividing the composite vibration substrate at predetermined dividing positions (step S209). In this step, the same splitting method as that of step S203 can be used.

In the vibration substrate 30 manufactured in step S209, the first protective film is not formed on the split faces.

The flow path spacer substrate 12 and the vibration substrate 30 are attached to each other via an adhesive, and the above-mentioned actuator unit (piezoelectric element spacer substrate 40, wiring substrate 50 and protective layer 60) are further layered to manufacture the intermediate layered substrate (step S210).

The second protective film 72 is formed on at least the surface of the intermediate layered substrate (step S211: second protective film forming). In this step, the same film forming method as that of step S202 can be used.

Next, the nozzle substrate 11 is attached to the intermediate layered substrate via an adhesive to manufacture the head chip 10 (step S212: nozzle substrate fixing). The obtained head chip 10 and the exterior member 102 are bonded via the adhesive 80 (step S213: exterior member bonding), and the other components are incorporated into the housing 101 and the exterior member 102 to complete the inkjet head 100.

Modification Example

A modification example of the second embodiment will be described.

In the above second embodiment, the second protective film 72 is formed on the surface of the intermediate layered substrate formed of the flow path spacer substrate 12, the vibration substrate 30, the piezoelectric element spacer substrate 40, the wiring substrate 50 and the protective layer 60. However, the second protective film 72 may be formed on the surface of a layered substrate in which the nozzle substrate 11 is further layered on the intermediate layered substrate. That is, the second protective film 72 may be formed on the surface of the nozzle substrate 11.

When a water-repellent film is provided on the nozzle opening surface of the nozzle substrate 11 in the modification example, the water-repellent film may be formed to be superposed on the second protective film 72 provided on the nozzle opening surface of the nozzle substrate 11.

Figure 17:
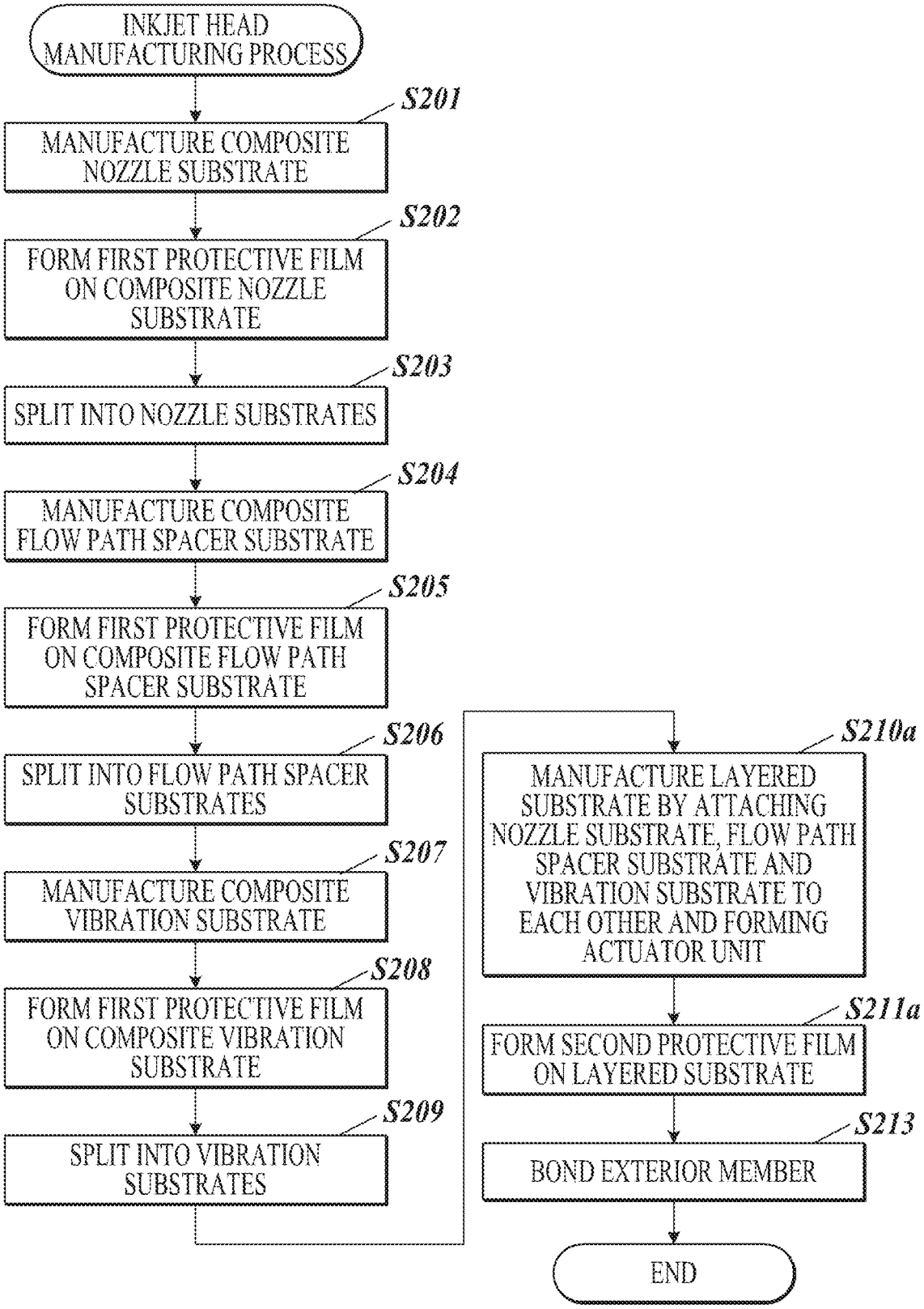
FIG. 17 is a flowchart explaining an inkjet head manufacturing process according to a modification example of the second embodiment.

FIG. 17 is a flowchart showing a manufacturing process of inkjet head 100 in the modification example.

The flowchart in FIG. 17 is obtained by changing the steps S210 and S211 in the flowchart of FIG. 16 to steps S210*a* and S211*a* and deleting step S212. Hereinafter, the difference from the flowchart in FIG. 16 will be described.

In the manufacturing process of inkjet head 100 of the modification example, after the steps S201 to S209 end, the intermediate layered substrate is manufactured by attaching the nozzle substrate 11 and the flow path spacer substrate 12 and the vibration substrate 30 to each other via an adhesive, and further layering the actuator unit (step S210*a*: nozzle substrate fixing). The head chip 10 is obtained by forming the second protective film 72 on the obtained intermediate layered substrate (step S211*a*: second protective film forming), and thereafter, the exterior member 102 is bonded to the head chip 10 (step S213: exterior member bonding) to complete the inkjet head 100.

In such a way, the present invention can also be applied to the inkjet head 100 of the bend mode. By the configurations of inkjet head 100 of the bend mode according to the second embodiment and the modification example, it is possible to more surely suppress the occurrence of trouble that the ink adhering to the surface of the flow path spacer substrate 12 enters and corrodes the ink flow path 121.

The present invention is not limited to the above embodiments and modification examples, and various changes can be made.

For example, each of the above embodiments and modification examples has been described by taking the flow path spacer substrate 12 and the wiring substrate 14 as an example of "flow path substrate". However, in addition to the flow path spacer substrate 12 and the wiring substrate 14, the pressure chamber substrate 13 in the first embodiment and the actuator unit in the second embodiment may be a configuration corresponding to the "flow path substrate". That is, after the first protective film 71 is formed on a composite substrate having a plurality of regions which forms pressure chamber substrates 13 by being split, the composite substrate may be split into the pressure chamber substrates 13 and the second protective film 72 may be formed on the split faces generated by the splitting. After the first protective film 71 is formed on a composite substrate having a plurality of regions which forms actuator units by being split, the composite substrate may be split into the actuator units and the second protective film 72 may be formed on the split faces generated by the splitting. In these cases, even when the pressure chamber substrate 13 or the actuator unit is manufactured by the splitting process of the composite substrate, it is possible to more surely suppress the trouble that the ink adhering from outside enters inside.

Each of the above embodiments and modification examples has been described by using an example in which each entire split face generated by splitting the composite substrate in each of the surfaces of the flow path spacer substrate 12, the wiring substrate 14 and the like is exposed in the surface of the head chip 10, and the protective film 72 is provided on the entire split face. However, the present invention is not limited to this. For example, in a configuration in which only a part of the split face generated by the splitting is exposed in the surface of the head chip 10, it is sufficient that the second protective film 72 is provided on at least the exposed part of the split face.

Though each of the above embodiments and the modification examples has been described by using an example in which the head chip 10 and the exterior member 102 are bonded via the adhesive 80, the present invention is not limited to this. For example, the head chip 10 may be fixed to the exterior member 102 directly or indirectly without an adhesive.

Though each of the above embodiments and the modification examples has been described by using an example in which the recording medium M is conveyed by the conveyance unit 2 including the conveyance belt 2*c*, the present invention is not limited to this. The conveyance unit 2 may convey the recording the recording medium M by holding the recording medium M on the outer circumferential surface of a rotating conveyance drum, for example.

Each of the above embodiments and the modification examples has been described by taking, as an example, the single pass type inkjet recording device 1. However, the present invention may also be applied to an inkjet recording device which records an image while causing the inkjet head 100 to perform scanning movement.

Though several embodiments of the present invention have been described above, the scope of the present invention is not limited to the above embodiments, and includes the scope of inventions, which is described in the scope of claims, and the scope equivalent thereof.

INDUSTRIAL APPLICABILITY

The present invention is applicable to an inkjet head manufacturing method, an inkjet recording device manufacturing method, an inkjet head, and an inkjet recording device.

EXPLANATION OF REFERENCE NUMERALS

1 inkjet recording device
2 conveyance unit
3 head unit
10 head chip
11 nozzle substrate
11*a* exposed face (split face)
111 nozzle
112 nozzle opening surface
11M composite nozzle substrate
12 flow path spacer substrate
12*a* exposed face (split face)
121 ink flow path
122 through flow path
123 individual ink discharge flow path
123*a* horizontal individual discharge flow path
123*b* vertical individual discharge flow path
12M composite flow path spacer substrate
13 pressure chamber substrate
131 pressure chamber
132 common ink discharge flow path
132*a* horizontal common discharge flow path
132*b* vertical common discharge flow path
133 drive electrode
134 dividing wall
135 connection electrode
14 wiring substrate
14*a* exposed face (split face)
141 ink supply port
142 discharge hole
143 wiring
20 FPC
30 vibration substrate
71, 71*a*, 71*b*, 71*c* first protective film
72 second protective film
80 adhesive
100 inkjet head
101 housing
102 exterior member
1021 top board
1021*a* recess formed surface
1021*b* exposing through hole

1022 lateral wall
1023 sealing plate
M recording medium
R recess

The invention claimed is:

1. An inkjet head manufacturing method for an inkjet head that includes a head chip including: a nozzle that ejects ink; and a flow path substrate including an ink flow path which communicates with the nozzle and through which the ink flows, the method comprising:

composite substrate manufacturing that is manufacturing a composite substrate including a plurality of regions which forms flow path substrates by being split, each of the flow path substrates being the flow path substrate;

first protective film forming that is forming a first protective film on a surface of the composite substrate and an inner wall surface of the ink flow path;

splitting that is splitting the composite substrate into the flow path substrates; and second protective film forming that is forming a second protective film on at least an exposed face in a split face of the flow path substrate generated in the splitting, the exposed face being exposed in a surface of the head chip.

2. The inkjet head manufacturing method according to claim 1, further comprising nozzle substrate fixing that is directly or indirectly fixing a nozzle substrate, in which an opening of the nozzle is provided, to the flow path substrate after the second protective film forming.

3. The inkjet head manufacturing method according to claim 1, further comprising nozzle substrate fixing that is directly or indirectly fixing a nozzle substrate, in which an opening of the nozzle is provided, to the flow path substrate before the second protective film forming, wherein the second protective film is formed on a surface of a layered substrate including the flow path substrate and the nozzle substrate in the second protective film forming.

4. The inkjet head manufacturing method according to claim 2, further comprising exterior bonding that is bonding an exterior to the head chip including the nozzle substrate and the flow path substrate with an adhesive after the second protective film forming, the exterior covering a part of the head chip while exposing a nozzle opening surface of the nozzle substrate in which the opening of the nozzle is provided, wherein a predetermined region excluding at least a part or whole of the exposed face of the flow path substrate in the surface of the head chip is bonded to the exterior with the adhesive in the exterior bonding.

5. The inkjet head manufacturing method according to claim 4, wherein the exterior includes a recess, a through hole is provided in the exterior, the through hole including an opening in an inner wall surface of the recess, and in the exterior bonding, the exterior is bonded to the head chip such that a portion including the nozzle opening surface and at least a part of the exposed face in the head chip protrudes outside the exterior from the opening of the through hole.

6. The inkjet head manufacturing method according to claim 1, wherein the first protective film is an inorganic oxide or an inorganic nitride that includes at least one of Ti, Al, Zr, Cr, Hf, Ni, Ta and Si, or polyparaxylylene.

7. The inkjet head manufacturing method according to claim 1, wherein the second protective film is an inorganic oxide or an inorganic nitride that includes at least one of Ti, Al, Zr, Cr, Hf, Ni, Ta and Si, or polyparaxylylene.

8. The inkjet head manufacturing method according to claim 1, wherein the flow path substrate is made of Si, metal or glass.

9. An inkjet recording device manufacturing method comprising the inkjet head manufacturing method according to claim 1.

* * * * *